US009814993B2

(12) United States Patent
Ponomarev et al.

(10) Patent No.: US 9,814,993 B2
(45) Date of Patent: Nov. 14, 2017

(54) INTERACTIVE TOY PLAYTHING HAVING WIRELESS COMMUNICATION OF INTERACTION-RELATED INFORMATION WITH REMOTE ENTITIES

(71) Applicant: Mera Software Services, Inc., Santa Clara, CA (US)

(72) Inventors: Dmitrii Maximovich Ponomarev, Nizhny Novgorod (RU); Nikolay Nikolaevich Mikhaylov, Vyazniky (RU); James Allen Hymel, San Jose, CA (US)

(73) Assignee: Mera Software Services, Inc., Santa Clara, CA (US)

( * ) Notice: Subject to any disclaimer, the term of this patent is extended or adjusted under 35 U.S.C. 154(b) by 579 days.

(21) Appl. No.: 14/162,857

(22) Filed: Jan. 24, 2014

(65) Prior Publication Data

US 2015/0133025 A1 May 14, 2015

(30) Foreign Application Priority Data

Nov. 11, 2013 (IL) ..... 229370

(51) Int. Cl.
*A63F 9/24* (2006.01)
*A63F 13/00* (2014.01)
(Continued)

(52) U.S. Cl.
CPC ..... *A63H 3/28* (2013.01); *A63H 3/36* (2013.01); *A63H 2200/00* (2013.01)

(58) Field of Classification Search
CPC ..... A63H 30/04; A63H 3/003; A63H 5/00; A63H 33/042; A63F 13/08; A63F 13/21;
(Continued)

(56) References Cited

U.S. PATENT DOCUMENTS 6,149,490 A 11/2000 Hampton et al.
6,415,439 B1 * 7/2002 Randell ..... H04L 67/12 348/61
(Continued)

FOREIGN PATENT DOCUMENTS

WO 00/31656 6/2000
WO 01/70361 9/2001
(Continued)

OTHER PUBLICATIONS

Wikipedia: iPhone, Nov. 9, 2010, <https://en.wikipedia.org/w/index.php?title=IPhone&oldid=395775444>.*
(Continued)

*Primary Examiner* — Milap Shah
*Assistant Examiner* — Janson Pinheiro
(74) *Attorney, Agent, or Firm* — Jose Gutman; Fleit Gibbons Gutman Bongini & Bianco P.L.

(57) ABSTRACT

An interactive toy plaything, method, and computer program product, monitor input signals from input devices such as an audio input device, a visual image input device, and a haptic detector, to determine that the interactive toy plaything is being interacted with and that interaction-related information corresponding to the interaction with the interactive toy plaything is to be communicated with at least one remote entity. The availability of the at least one remote entity to communicate with the interactive toy plaything over a wireless communication network is determined. If it is available, wirelessly transmitting the interaction-related information to the at least one remote entity over the wireless communication network. A remote entity can be a mobile phone.

14 Claims, 11 Drawing Sheets

(51) Int. Cl.

| | |
|---|---|
| ***G06F 17/00*** | (2006.01) |
| ***G06F 19/00*** | (2011.01) |
| ***A63H 3/28*** | (2006.01) |
| ***A63H 3/36*** | (2006.01) |

(58) Field of Classification Search
CPC ..... A63F 13/215; A63F 13/23; A63F 13/31; A63F 13/327
See application file for complete search history.

(56) References Cited

U.S. PATENT DOCUMENTS

| | | | | |
|---|---|---|---|---|
| 6,773,344 | B1 | 8/2004 | Gabai et al. | |
| 7,016,849 | B2 | 3/2006 | Arnold et al. | |
| 7,092,928 | B1 | 8/2006 | Elad et al. | |
| 2004/0014014 | A1 | 1/2004 | Hess | |
| 2004/0147814 | A1 | 7/2004 | Zancho et al. | |
| 2006/0036751 | A1 | 2/2006 | Garbow et al. | |
| 2007/0117630 | A1* | 5/2007 | Fowler | A63F 13/12 463/42 |
| 2007/0173326 | A1* | 7/2007 | Jennings | A63F 13/79 463/42 |
| 2008/0305784 | A1 | 12/2008 | Dillinger et al. | |
| 2009/0137185 | A1* | 5/2009 | Zheng | A63H 11/00 446/268 |
| 2009/0253554 | A1 | 10/2009 | McIntosh | |
| 2010/0167623 | A1 | 7/2010 | Eyzaguirre et al. | |
| 2010/0197411 | A1 | 8/2010 | Eyzaguirre et al. | |
| 2011/0053129 | A1 | 3/2011 | Basson et al. | |
| 2012/0158158 | A1 | 6/2012 | Spring | |
| 2013/0102852 | A1 | 4/2013 | Kozloski et al. | |

FOREIGN PATENT DOCUMENTS

| | | |
|---|---|---|
| WO | 0169572 | 9/2001 |
| WO | 0169799 | 9/2001 |
| WO | 0169829 | 9/2001 |
| WO | 0170361 | 9/2001 |

OTHER PUBLICATIONS

Office Action dated May 8, 2014 for Israeli Patent Application No. 229370.

Schmid, S., et al., "Networking Smart Toys with Wireless ToyBridge and ToyTalk," Proc. IEEE Infocom (poster abstract), Apr. 2011, pp. 1-2, Shanghai, China.

Non-Final Office Action dated Dec. 1, 2015, for U.S. Appl. No. 14/613,696.

* cited by examiner

*FIG. 7*

702

| 704 Entity ID | 706 Profile | 708 Status | 710 Audio From | 712 Video From | 714 Audio To | 716 Video To |
|---|---|---|---|---|---|---|
| | | | | | | |
| | | | | | | |
| | | | | | | |
| | | | | | | |
| | | | | | | |
| | | | | | | |
| | | | | | | |
| | | | | | | |

INTERACTIVE TOY PLAYTHING HAVING WIRELESS COMMUNICATION OF INTERACTION-RELATED INFORMATION WITH REMOTE ENTITIES

CROSS-REFERENCE TO RELATED APPLICATION

This application is related to co-pending Israeli Patent Application No. 229370, for "Interface Apparatus And Method For Providing Interaction Of A User With Network Entities", filed on Nov. 11, 2013; the disclosure thereof being herein incorporated by reference in its entirety.

FIELD OF THE DISCLOSURE

The present disclosure generally relates to interactive toys, and more particularly to an interactive toy plaything that wirelessly communicates interaction-related information with remote entities over communication networks.

BACKGROUND

Traditionally, toys (also referred to as toy playthings) are designed for entertainment, education and amusement of children. Due to their tactile proximity, children can interact with and derive fun and comfort from toys. Additionally, children can be provided with toys, such as dolls, teddy bears, or plush animals that can also be used as transitional objects or companions, to reduce strain and allow for regaining psychic equilibrium, thus helping a young individual to cope with past and present trauma, anxiety, depression and psychic pain. A typical example of a transitional object is a baby blanket that is carried everywhere and that the child sleeps with for comfort. Adults can also benefit from the proximity of an object that offers tactile contact and that soothes or that even can render soothing words. In this connection, toys and other interactive companion devices are most beneficial when they can actively respond to commands of the user rather than behave passively in the manner of traditional toys.

There are known various types of toys for children that can be associated with recording and playback equipment, for example, with speakers so the toys can communicate with a user. There are known toys which can be responsive to triggering external user inputs, such as touch or spoken words or sounds. For example, U.S. Pat. No. 6,890,239 to Kopelle describes a transitional companion in the form of a talking therapy buddy for providing reassurance to a person and for self-healing. The therapy buddy includes a body assembly with an outer covering of soft material and an interior body cavity, a head portion having a face with calm and tranquil features, two elongated flexible arms and legs, an electronic circuit including a sound module housed in the body cavity and a power source. A plurality of switching means are provided covered by the outer covering, and associated with the legs of the assembly and connected to the electronic circuit so as to provide a switch signal response to a person's touching of the respective leg portion switch. The sound means can include a voice synthesizing means for electronic synthesizing a plurality of soothing, reassuring, comforting, and universal words in response to a switch signal provided. The voice synthesizing means includes speaker means for audibilizing the electronically synthesized words.

There are known more sophisticated toys which can respond to signals transmitted through a television program or a computer so that the toys appear to react to the television program or computer. For example, U.S. Pat. No. 6,773,344 to Gabai et al. describes methods and apparatus for integrating interactive toys with interactive television and cellular communication systems. Interactive toys can have real time conversations with users, employing speech recognition. Interactive toys can be connected to an interactive toy server which is connected to entertainment, education, sales promotion and other content providers via Internet communication systems. Such a connection may utilize, for example, telephone lines, cellular communication systems, coaxial cables, satellite, DSL or other broadband systems. Interactive toys may be connected, via a wireless link, to a computing device such as a home computer, an interactive television set-top box or a base unit which provides Internet connectivity for the toy. Interactive toys may support mobile cellular or satellite communication. These toys are able to provide entertainment, education, sales promotion and other content to a user. Content is provided to users for their toys, which enables toys to form relationships with users. Interactive toys further utilize user knowledge bases to match entertainment, education and sales promotion content to user histories, behaviors and habits. Content is thus personalized to an individual user as well as to a user's environment including the user's location and the time at which the toy is used. Integration of content, such as entertainment, education and sales promotion is provided by merging interactive television techniques with interactive toys.

International Patent Application No. WO2012/014211 to Cohen et al describes a toy apparatus and method for interactive communication between a cellphone and a toy. The method includes transmitting by the cellphone at least one signal; receiving and analyzing by the toy apparatus this signal; determining and producing by the toy apparatus a response to this signal.

BRIEF SUMMARY

According to various embodiments of the present disclosure, a smart toy apparatus or also referred to as an interactive toy plaything can be equipped with a wireless communication platform that can operate as an interface for interaction between a user of the interactive toy, such as a child, and the surrounding external world including various remotely located entities that are configured for providing network communication services accessible in cyber-space.

According to an embodiment, an interface apparatus is implemented in the form of a smart toy or an interactive toy plaything that can provide enhanced interactive communication with a child that plays and uses such interactive toy plaything for communication with various entities over a communication network. In particular, such interactive toys may include an embedded wireless communication platform together with an intelligent communication system that can be used for interaction between a user of the interactive toy plaything and one or more remote entities over a wireless communication network. Information exchanged between the interactive toy plaything and the one or more remote entities can include, but is not limited to, responses to requests for interaction, interaction-related information from the user of the interactive toy plaything to one or more remote entities, interaction-related information from a user of a remote entity to the interactive toy plaything, vital signs of the user, detection of physiological and emotional states of the user, and other requested information targeted between different network entities and the user.

It would also be advantageous to have a smart toy or interactive toy plaything with an interface apparatus that can interact with one or more children using the toy, and also provide interactive communication between the one or more children and one or more of the network entities. As an example, a child interacting with the interactive toy plaything can send interaction-related information to one or more remote entities, such as the child's individual parents using smart phones or tablets, over a wireless communication network. This exchange of information would be an intuitive and natural communication of information that allows a child to affirmatively engage the attention of the user of a remote entity, such as the child's mother or father, and then the child can exchange interaction-related information and request for interaction over a wireless communication network, with the parents possibly located far away from where the child is interacting with the interactive toy plaything. As another example, a child can receive new, useful knowledge in an educational exchange of interaction-related information between the child interacting with the interactive toy plaything, as a teaching tool, and one or more remote entities that are engaged as teachers or facilitators for such an educational interactivity with the child. These features can significantly increase the value of toys for children, for example, through more interesting, exciting and useful learning and gameplay.

Thus, according to various aspects of the present invention, an interface apparatus (e.g., the interactive toy plaything) can provide interaction over a wireless communication network between a user of an interactive toy plaything and one or more remote network entities cooperating with said interface apparatus.

BRIEF DESCRIPTION OF THE DRAWINGS

The accompanying figures in which like reference numerals refer to identical or functionally similar elements throughout the separate views, and which together with the detailed description below are incorporated in and form part of the specification, serve to further illustrate various embodiments and to explain various principles and advantages all in accordance with the present disclosure, in which:

FIG. 7 is a table showing one example of an entity status memory for the interactive toy plaything of FIG. 5;

DETAILED DESCRIPTION

Figure 1:
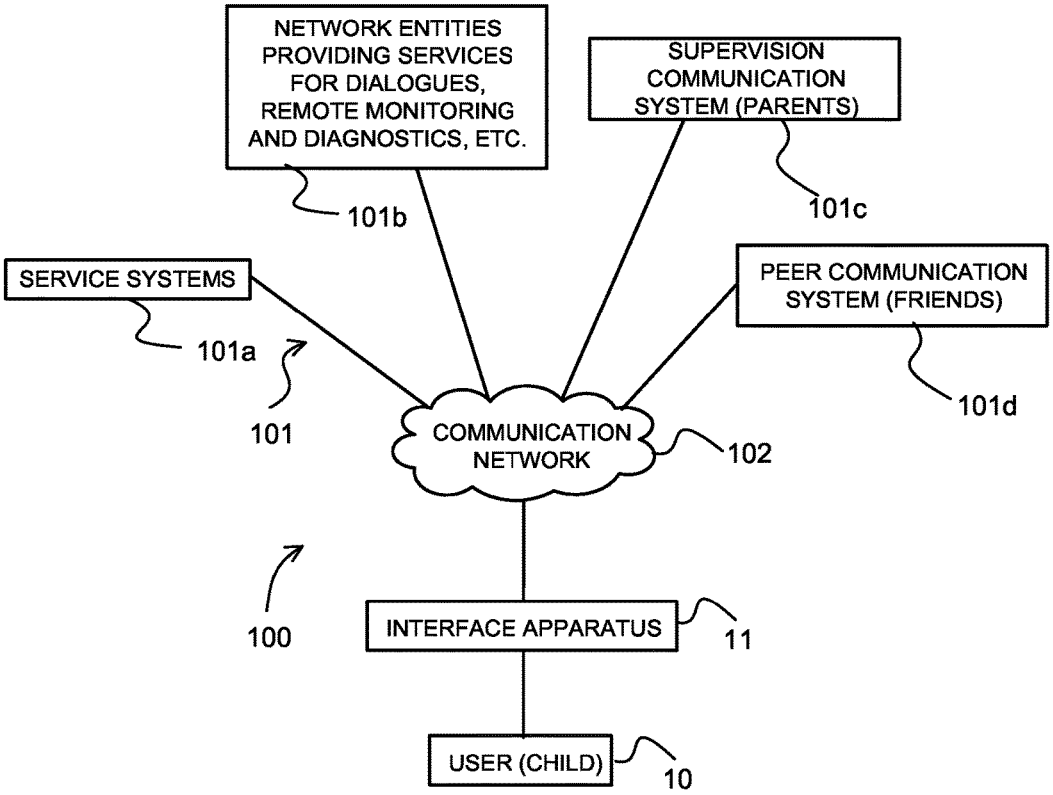
FIG. 1 illustrates a general schematic block diagram of a system for providing interaction of users with a plurality of entities over a communication network, according to an embodiment of the present invention.

This invention, according to various embodiments, offers a smart toy apparatus, or also referred to as an interactive toy plaything, equipped with a wireless communication transceiver that can operate as an interface apparatus for interaction between a child using the toy and the surrounding external world including various entities that are configured for providing network communication services accessible in cyber-space such as over the Internet.

It would be beneficial to have an interface apparatus implemented in the form of a smart toy that can provide the possibility of enhanced interactive communication with children that may play and use such toys for communication with various entities over a communication network. In particular, such smart toys having an embedded wireless communication transceiver together with an intelligent communication system may be used for interaction, and exchange of interaction-related information, with network entities that are remotely located from the toy. Information exchanged between the interactive toy plaything and the one or more remote entities can include, but is not limited to, responses to requests for interaction, interaction-related information from the user of the interactive toy plaything to one or more remote entities, interaction-related information from a user of a remote entity to the interactive toy plaything, vital signs of the user, detection of physiological and emotional states of the user, and other requested information targeted between different network entities and the user of the interactive toy plaything.

It would also be advantageous to have a smart toy interface apparatus that can have the capabilities to interact with children, and also provide interactive communication between the children and the network entities for teaching various subjects. Thus, children will be able to receive new, useful knowledge through interaction with such a device. These features can significantly increase the value of toys for children, for example, through more interesting, exciting and useful learning and gameplay.

It would helpful to have the possibility of automatic reconfiguration and control of functionality of the interface apparatus in order to automatically adjust the interface apparatus to changes in operating conditions of the communication network.

It would also be beneficial to have the possibility of automatic reconfiguration and control of functionality of the network entities in order to adjust their operation to predetermined requirements, thus ensuring most effective interaction between the interface apparatus and the network entities.

Thus, the present application partially eliminates disadvantages of conventional interactive toys that can respond to signals transmitted from a computer, and provides an enhanced user interface apparatus that can be adaptive and smart for interaction with various remote entities such as cloud network entities.

Although most of the applications of the interface apparatus of the present application will be addressed to children and young users, it should be understood that adults can also utilize this interface apparatus, and thus benefit from the advantages provided by the embodiments of the present invention.

Due to the operation of different monitoring devices built into the interface apparatus of various embodiments of the present invention, such as front-end sensors, a video camera, a microphone, etc., the operation functionality of the interface apparatus can be automatically adapted to the character, behavior and requirements of the particular user. The data signals from the monitoring devices can be obtained and analyzed for providing control of physiological and emotional states of the user, for example, by providing advice to the user and targeting required information from various network entities to the user.

According to some embodiments of the present invention, the adaptability of the interface apparatus to the individual character, mood, behavior and requirements of a particular child can also be achieved not only by the tools which are built into the child interface apparatus itself, but can also be achieved through the infrastructure of the external network components, for example through specialized machine-to-machine (M2M) services deployed on the basis of cloud technologies on Internet servers, which can be available for the interface apparatus via wireless communication, such as: WiFi, Long-Term Evolution (marketed as 4G LTE), Worldwide Interoperability for Microwave Access (WiMAX), and also other wireless communication standards and protocols.

Depending on the information obtained about a user, the type of interaction of the interface apparatus with the user can be adjusted depending on the features of the particular user, such as user's age, gender, emotional and physiological state, etc. It can also be adjusted to the instant situation accordingly in the context of this interaction.

According to some embodiments of the present invention, the interface apparatus can be implemented in the form of interactive toys, such as stuffed animals, dolls, toy robots or any other figurines that include electronics, however other implementations are also contemplated. When desired, the interface apparatus can be implemented in the form of a smart baby carriage or a stroller. Likewise, the interface apparatus can be realized in the form of a baby cot, as well as in the form of a specialized garment for children, which can be equipped with a set of front-end sensors configured to monitor the state of the child and his current location, etc. In order to provide interactive communication with a child, the interface apparatus can be equipped with a microphone, a speaker, a camera, a display and other devices.

Various scenarios are contemplated for using the interface apparatus of the present invention for interaction with various network entities.

In particular, when the interface apparatus is realized as an interactive toy plaything, it can employ voice dialogs for communication with the child. The voice dialogs can be conducted in natural (ordinary) languages by interactively talking with and listening to the child, and answering the child's questions. When desired, such dialogs may be thematic and directed to a certain purpose.

When desired, such dialogs with the toy interface apparatus can be implemented for playing educational games. In this case, a cognitive dialog can be created around a predefined topic, so that the child can be actively involved in the process of acquiring new knowledge.

In particular, when the interface apparatus is used as a transitional object or a companion, the technical means for organization and conducting relatively simple dialogs can be built into the interface apparatus itself. However, in the case of entertainment, education or amusement of the child, the corresponding technical means for conducting more complex dialogs can already be deployed in the external entity rather than in the interface apparatus itself. In this case, the remote entity can, for example, comprise a personal computer (or a laptop) operating within a home network or a smart phone operating over a wireless communication network. Further, in the case of most sophisticated topics for dialogs, the dedicated machine-to-machine (M2M) services can be deployed on dedicated servers by using various Internet cloud-based technologies, which can be available to the interface apparatus for an organization and for conduction of such dialogs through wireless communication.

When desired, the interface apparatus can operate in the "child care" scenario. In this case, the interface apparatus allows the parents permanently to watch over the child and receive information about the child's behavior, interaction with the interactive toy plaything, and the child's emotional and physiological states. In particular, with the help of a video camera and microphone built into the toy interface apparatus, the parents can watch and listen to the child by using their smart phone, tablet laptop, notebook or other smart communication devices. When a built-in GPS receiver is used in the toy interface apparatus, the parents can also keep track of the whereabouts of the child carrying his interface apparatus.

According to some embodiments of the present invention, the interface apparatus can be equipped with various monitoring sensors configured for measuring physiological parameters of the user, such as his temperature, pulse rate, skin resistance, etc. This provision allows monitoring the health of the child user, and in the case of emergency, to respond to measured vital signs, if the signs indicate health disorders or diseases.

It is also advantageous that such measurements can be carried out in a child-friendly manner. For example, when the interface apparatus is in the form of a child's favorite teddy bear, various front-end monitoring devices and sensors can be arranged in a paw of the toy. In operation, the teddy bear may, for example, utter: "Let's be friends! Dear friend, please take my paw, etc." Accordingly, when the child picks up the toy by the paw, the toy can measure the child's temperature. In this case, if the temperature is not normal, a special notice can be generated and transferred to the parents of the child, for example to their communication device, such as a smart phone, a tablet computer, a laptop, a smart TV, etc.

According to some embodiments of the present invention, a video image of the child, as well as a sound of his voice can be captured by a front-end video camera and microphone built into the apparatus, respectively, and then be transmitted via the Internet to the corresponding M2M remote monitoring services, where these signals may also be combined with information obtained from various front-end sensors built into the apparatus. A decision making system can be employed in the interface that can carry out a detailed analysis of the data and identify various situations associated with the child, e.g., crying, laughing, running, sitting, standing, etc.

According to some embodiments of the present invention, the interface apparatus can be configured for identification of certain diseases having external manifestation, e.g., epilepsy, etc. Based on conversations with the child, the motor skills of his speech and his motor activity, the apparatus can recognize different abnormalities in the development of the child.

According to some embodiments of the present invention, on the basis of Internet protocol telephony (IP telephony) technologies, the interface apparatus can maintain remote communication between several users using similar interface apparatuses. When desired, the interface apparatus may imitate the basic communication functions of an IP phone. For example, by using the interface apparatus of the present invention, children can call to their peer friends (e.g., via the Internet with the support of a specialized M2M service) and chat with them.

These and other useful features and properties of the smart interactive interface apparatus of the present invention can significantly boost its consumer properties in the market, and make them more attractive and competitive for buyers.

For the purpose of the present application, the term "network entity" refers to sources and recipients of data signals transmitted from the interactive interface apparatus (e.g., an interactive toy plaything) of the present invention over a communication network. The network entities can, for example, and not for limitation, represent people, organizations, other communication systems, computer systems, wireless communication devices such as smart phones and tablets, etc.

The terms "front-end" and "back-end" are used to characterize devices, program interfaces and services relative to the initial user of these interfaces and services. The "user" may be a child or an adult.

Thus, according to one general aspect of the present invention, there is provided an interface apparatus for providing interaction over a communication network between a user and a plurality of network entities cooperating with said interface apparatus.

According to some embodiments of the present invention, the interface apparatus includes a front-end communication system including one or more front-end communication input devices and one or more front-end communication output devices. The front-end communication input devices are configured for interaction with the user for receiving user input information and for generating user information input signals. The front-end communication output devices are configured for interaction with the user for outputting user information output signals obtained as reactions to the user input information.

According to some embodiments of the present invention, the interface apparatus also includes a communication processing system coupled to the front-end communication system. The communication processing system is configured for receiving user information input signals for coding thereof to a format suitable for data transfer and forwarding coded information input signals to one or more network entities over the communication network. The network entities are configured for handling communication with the user. The communication processing system is also configured for receiving coded information output signals and decoding these signals to obtain user information output signals in a format suitable for outputting thereof by one or more front-end output devices.

According to some embodiments of the present invention, the interface apparatus further includes a front-end monitoring system including one or more front-end monitoring devices configured for interacting with the user, collecting user state information related to a state of the user, and generating user state patterns indicative of the state of the user.

According to some embodiments of the present invention, the interface apparatus further includes a decision-making system coupled to the front-end monitoring system and configured for receiving user state patterns collected by the front-end monitoring devices, and for processing thereof for taking a decision as to how to respond to the received user state patterns.

According to some embodiments of the present invention, the interface apparatus further includes a configuration and control system configured (i) for automatic reconfiguration and control of functionality of the interface apparatus to adjust the interface apparatus to operating conditions of the communication network, and (ii) for automatic reconfiguration and control of functionality of the network entities to adjust operation of the network entities to the predetermined requirements imposed thereon for desired cooperation with the interface apparatus.

According to various embodiments of the present invention, the interface apparatus further includes a wireless network connector electrically coupled to the decision-making system, to the communication processing system, and to the configuration and control system. The wireless network connector is configured for providing a wireless signal linkage between the interface apparatus communicating over a wireless communication network and the plurality of the network entities operating over the machine-to-machine and/or other one or more communicatively coupled communication networks.

According to some embodiments of the present invention, the interface apparatus further includes an interface for remote monitoring (hereinafter also referred to as "remote monitoring interface") coupled to the communication processing system and to the decision-making system. The interface for remote monitoring is configured for interaction of the interface apparatus with the plurality of network entities.

According to some embodiments of the present invention, the front-end communication input devices of the front-end communication system include a microphone configured for receiving user input information provided verbally and converting user information into user information input signals corresponding to user verbal input information.

According to some embodiments of the present invention, the front-end communication input devices of the front-end communication system include a video camera configured for receiving user information provided visually and converting user information into user information input signals corresponding to visual user information.

According to some embodiments of the present invention, the front-end communication output devices of the front-end communication system include a speaker configured for audio outputting user information output signals, and a display configured for video outputting user information output signals. The user information output signals are indicative of reactions of one or more network entities on the user information input signals.

Examples of front-end monitoring devices of the front-end monitoring system include, but are not limited to, a tactile sensor configured to provide user state information indicative of a force applied by the user to the interface apparatus; one or more user physiological parameter sensors configured for measuring at least one vital sign of the user; a user location sensor configured for determination of a location of the interface apparatus; an accelerometer configured for detecting motion of the interface apparatus; and a gyroscope configured for measuring orientation of the interface apparatus in space. Examples of user physiological parameter sensors include, but are not limited to a temperature sensor, a pulse rate sensor, a blood pressure sensor, a pulse oximetry sensor, and a plethysmography sensor.

According to some embodiments of the present invention, the communication processing system includes an encoding and decoding module coupled to the front-end communication input devices and to the front-end communication output devices of the front-end communication system.

According to some embodiments of the present invention, the encoding and decoding module is configured for receiving user information input signals including audio and video signals from the front-end communication input devices for coding thereof, and for forwarding coded information input signals to the wireless network connector for relaying coded information input signals to one or more network entities.

According to some embodiments of the present invention, the encoding and decoding module is further configured for receiving coded information output signals and decoding these signals to obtain user information output signals.

According to some embodiments of the present invention, the communication processing system also includes a speech synthesizer coupled to the speaker and to the module for encoding and decoding audio signals. The speech synthesizer is configured to receive decoded information output signals and to generate electrical signals in a format suitable for audio-outputting thereof by the speaker.

According to some embodiments of the present invention, the communication processing system also includes a view synthesizer coupled to the display and to the module for encoding and decoding video signals, and configured to receive decoded information output signals and to generate electrical signals in a format suitable for video-outputting thereof by the display.

According to some embodiments of the present invention, the interface apparatus further includes a local dialog organization device coupled to the speech synthesizer and to the remote monitoring interface. The local dialog organization device is configured for organization of a dialog between the user and the interface apparatus.

According to some embodiments of the present invention, the decision-making system includes a sensor data collection module configured for receiving user state patterns measured by the front-end monitoring system and formatting thereof.

According to some embodiments of the present invention, the decision-making system also includes a pattern recognition device coupled to the sensor data collection device. The pattern recognition device is configured for comparing user state patterns with reference state patterns stored in the interface apparatus, and for generating an identification signal indicative of whether at least one of the user state patterns matches or does not match at least one reference state pattern. The reference state patterns are indicative of various predetermined states of the user and are used as a reference for determining a monitored state of the user.

According to some embodiments of the present invention, the decision-making system also includes a pattern storage device coupled to the pattern recognition device and configured for storing the reference state patterns.

According to some embodiments of the present invention, the decision-making system also includes a decision maker device coupled to the pattern recognition device. The decision maker device is configured to receive the identification signal from the pattern recognition device, and in response to said identification signal, to generate coded information output signals indicative of at least one policy for taking a decision as to how to respond.

According to some embodiments of the present invention, the decision-making system also includes a policy storage device coupled to the decision maker device and configured for storing policies for taking the decision.

According to some embodiments of the present invention, the policy for taking the decision includes at least the following two actions:

(1) if at least one of the user state patterns matches at least one reference state pattern, to generate the coded information output signals indicative of advice of the decision-making system as a reaction to the monitored state of the user, and to provide e coded information output signals to at least one receiver selected from a corresponding at least one network entity configured for handling the advice, and the communication processing module of the interface apparatus for decoding thereof and providing advice to the user; and (2) if none e of the user state patterns matches at least one reference state pattern, the policy for the taking of the decision includes instructions to forward the monitored user state patterns to a corresponding at least one network entity selected from the plurality of network entities. The corresponding at least one network entity is configured for handling the user patterns.

According to some embodiments of the present invention, the configuration and control system includes a cyber-certificate database. The cyber-certificate database includes at least one record selected from: a record with a description of functional characteristics of the interface apparatus; a record with a description of functional characteristics of the network entities selected to cooperate with the interface apparatus for a predetermined purpose; a record with a description of functional characteristics of said plurality of network entities providing services to which the interface apparatus has a right to access; an archive record for interaction of the user with the interface apparatus; and a cyber-portrait of the user including at least one kind of characteristics selected from: cognitive characteristics of the user, behavioral characteristics of the user, physiological characteristics of the user, and mental characteristics of the user.

According to some embodiments of the present invention, the configuration and control system includes a cyber-certificate database controller coupled to the cyber certificate database. The configuration and control system is configured for controlling access to the records stored in the cyber certificate database for reading and updating the records.

According to some embodiments of the present invention, the configuration and control system includes a reconfiguration device configured for dynamic reconfiguration of functionality of the interface apparatus. The reconfiguration device is coupled to the cyber-certificate database controller. The dynamic reconfiguration of functionality of the interface apparatus can include, according to various embodiments, at least the following operations:

(1) receiving external signals for adjusting the interface apparatus to the operating conditions of the communication network, and adjusting operation of the corresponding external entities to the predetermined requirements imposed on these external entities for cooperation with the interface apparatus; and (2) providing instruction signals to the cyber certificate database controller for reading and updating the database records.

According to another general aspect of the present invention, there is provided a system for interaction of users with a plurality of entities over a communication network. The system includes one or more user interface apparatuses described above, and the plurality of entities.

According to some embodiments of the present invention, the user interface apparatus can interact with an external dialog system configured for organization and conduction of natural language dialogs with the user. Specifically, the external dialog system is configured for receiving coded information input signals originating from the front-end communication system. The external dialog system is also configured for analyzing the received input signals and for generating coded information output signals as a reaction to the coded information input signals. These coded information output signals can be forwarded to the interface apparatus for decoding and outputting to the user.

According to an embodiment of the present invention, the external dialog system includes a speech recognition system configured for receiving the coded information input signals originating from the front-end communication system and for transforming these signals into data suitable for computer processing.

According to an embodiment of the present invention, the external dialog system also includes a dialog manager coupled to the speech recognition system, and configured to process said data and to generate the coded information output signals, which are generated as a reaction to the coded information input signals.

According to one embodiment of the present invention, the coded information input signals include a query signal. In this embodiment, the dialog system can include a search engine associated with the dialog manager. The search engine is configured for receiving a processed query signal from the dialog manager, for conducting a search based on a query related to the query signal and for providing search results to the dialog manager for targeting thereof to the user. The search results can be included in the coded information output signals.

According to an embodiment, the coded information input signals include user state patterns forwarded by the decision-making system. In this embodiment, the dialog system is also configured to analyze the user state patterns, and to generate advice of the entity as a reaction to the monitored state of the user. The entity advice can be included in the coded information output signals.

According to some embodiments of the present invention, the user interface apparatus can interact with a supervisor communication support system. The supervisor communication support system is configured for finding a supervisor communication device used by a supervisor of the user and supporting communication of the user interface apparatus with the supervisor communication device. For example, the user of the interface apparatus can be a child, the supervisor can be a parent of the child, and the supervisor communication device can be a communication device of the parent.

According to some embodiments of the present invention, the user interface apparatus can interact with a situation identification system. The situation identification system is configured for receiving coded information input signals originating from the front-end communication system and user state patterns forwarded by the decision-making system, and for carrying out an analysis thereof for identifying various situations occurring with the user and notifying the supervisor communication support system of these situations as they are discovered. For example, the situation identification system can be configured to communicate with a network system providing medical diagnostics service.

According to some embodiments of the present invention, the user interface apparatus can interact with a peer communication support system. The peer communication support system is configured for finding one or more other interface apparatuses used by peers to the user and for supporting communication between the interface apparatus of the user and the other interface apparatuses. For example, the user of the interface apparatus can be a child, and the peer can be another child.

According to some embodiments of the present invention, the user interface apparatus can interact with an entities control system configured for conducting a semantic search and management of the plurality of network entities in order to provide cloud services to the user of the interface apparatus.

According to yet another general aspect of the present invention, there is provided a method for interaction of users with a plurality of network entities over a communication network by using the interface apparatus described above.

According to an embodiment of the present invention, the method includes at the interface apparatus end adjusting the interface apparatus to operating conditions of the network entities providing services in the communication network, and reconfiguring and controlling functionality of the network entities for adjusting operation of the network entities to predetermined requirements imposed on the external entities for cooperation with the interface apparatus.

According to an embodiment of the present invention, the method further includes receiving user input information from the user; processing the user input information and forwarding the corresponding processed signal to one or more network entities. The method also includes receiving coded information output signals from one or more network entities, and processing thereof to obtain user information output signals in a format suitable for outputting to the user.

According to various embodiments, the method further includes collecting user state information related to a state of the user and generating user state patterns indicative of the state of the user. The method further includes receiving user state patterns and processing thereof, and taking a decision as to how to respond to the received user state patterns. The taking of the decision as to how to respond to the received user state patterns includes the following scenarios:

(1) if at least one of the user state patterns matches at least one reference state pattern, taking a decision to generate the coded information output signals indicative of advice as a reaction to the monitored state of the user, and providing coded information output signals for decoding thereof, and providing advice to the user; and (2) if none of the user state patterns matches at least one reference state pattern, forwarding the monitored user state patterns to a corresponding at least one entity configured for handling the user patterns.

According to an embodiment, the processing of the user state patterns includes comparing the user state patterns with reference state patterns stored in the interface apparatus; and taking a decision as to how to respond to the received user state patterns. The reference state patterns can be indicative of various predetermined states of the user and can be used as a reference for determining a monitored state of the user.

According to some embodiments of the present invention, the method comprises at the end of at least one entity: receiving from the interface apparatus the input signals selected from the coded information input signals and the user state patterns; analyzing the input signals, and generating coded information output signals, which are reactions to the coded information input signals; and relaying the coded information output signals to the interface apparatus.

According to some embodiments of the present invention, the method comprises at the end of at least one entity: receiving, from the interface apparatus, input signals selected from said coded information input signals and said user state patterns; providing analysis thereof for identifying various situations occurring with the user; finding a supervisor communication device used by a supervisor of the user; and providing communication of the supervisor communication device with the interface apparatus of the user.

According to some embodiments of the present invention, the method comprises at the end of at least one entity: receiving, from the interface apparatus, coded information input signals; finding one or more other interface apparatuses used by peers to the user, and providing communication between the interface apparatus of the user and the other interface apparatuses.

According to an embodiment, the processing of the user state patterns includes comparing the user state patterns with reference state patterns stored in the interface apparatus; and taking a decision as to how to respond to the received user state patterns. The reference state patterns can be indicative of various predetermined states of the user and can be used as a reference for determining a monitored state of the user.

The detailed description provides additional details and advantages of various embodiments of the invention.

LIST OF REFERENCE NUMERALS

10—User
11—Interface apparatus
100—System
101—Network entities
101*b*—Examples of network entities (Service systems)
101*c*—Example of network entity (Supervisor communication system)
101*d*—Example of network entity (Peer communication system)
102—Communication network
105—Tactile sensor
106—Gyroscope
107—View synthesizer (VS)
108—Speech synthesizer (SS)
109—Encoding and decoding (E/D) module
111—Communication processing system (CPS)
112—Front-end communication system (FECS)
113—Front-end monitoring system (FEMS)
114—Decision-making system (DMS)
115—Speaker
116—Video camera
117—Microphone
118—Display
119—Interface for remote monitoring (RMI)
120—Wireless network connector (WNC)
121—User physiological parameter sensor (UPPS)
122—Location sensor (LS)
123—Accelerometer sensor (AS)
124—Sensor data collection device (SDCD)
125—Pattern recognition device (SRD)
126—Pattern storage device (PaSD)
127—Policy storage device (PoSD
128—Decision maker device (DMD)
129—Configuration and control system (CCS)
130—Cyber certificate database (CCD)
131—Cyber certificate database controller (CCDC)
132—Reconfiguration device (RD)
133—Entities control system (ECS)
140—External dialog system (EDS)
141—Speech recognition system (SRS)
143—Search engine (SE)
142—Dialog manager (DM)
144—Supervisor communication support system (SCSS)
145—Supervisor communication devices (SCD)
146—Situation identification system (SIS)
147—Peer communication support system (PCSS)
148—Peer interface apparatuses (OEA)
150—Local dialog organization device (LDOD)
151—Conversation controller (CC)
152—Conversation database (CD)
502—interactive toy plaything, which can be in the form of a teddy bear toy
504—display, can be a video output device
506—displayed image(s) that are displayed on the display
508—audio output device, for example a speaker
510—audio input device, for example a microphone
512, 514, 516, 518, 520, 522, 524, 526, 528, 530, 532, 534—haptic detectors
540, 542—video input device, can be a video detector The principles and operation of the system and method for providing interaction of users with a plurality of entities over a communication network according to the present invention may be better understood with reference to the drawings and the accompanying description, it being understood that these drawings and examples in the description are given for illustrative purposes only and are not meant to be limiting. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments. In addition, the description and drawings do not necessarily require the order illustrated. It will be further appreciated that certain actions and/or steps may be described or depicted in a particular order of occurrence while those skilled in the art will understand that such specificity with respect to sequence is not actually required.

System, device and method components have been represented where appropriate by conventional symbols in the drawings, showing only those specific details that are pertinent to understanding the various embodiments so as not to obscure the disclosure with details that will be readily apparent to those of ordinary skill in the art having the benefit of the description herein. Thus, it will be appreciated that for simplicity and clarity of illustration, common and well-understood elements that are useful or necessary in a commercially feasible embodiment may not be depicted in order to facilitate a less obstructed view of these various embodiments.

The same reference numerals and alphabetic characters will be utilized for identifying those components which are common in the system for providing interaction of users with a plurality of entities over a communication network and its components shown in the drawings throughout the present description of the invention. It should be noted that the blocks in the drawings illustrating various embodiments of the present invention are intended as functional entities only, such that the functional relationships between the entities are shown, rather than any physical connections and/or physical relationships.

Some portions of the detailed descriptions, which follow hereinbelow, are presented in terms of algorithms and/or symbolic representations of operations on data represented as physical quantities within registers and memories of a computer system. An algorithm is here conceived to be a sequence of steps requiring physical manipulations of physical quantities and leading to a desired result. Usually, although not necessarily, these quantities take the form of electrical or magnetic signals capable of being stored, transferred, combined, compared, and otherwise manipulated. In the present description, these signals can be referred to as values, elements, symbols, terms, numbers, or the like.

Referring to FIG. 1, a general schematic block diagram of a system 100 for providing interaction of one or more users 10 with one or more network entities 101 over a communication network 102 is illustrated, according to one embodiment of the present invention. The system includes one or more interface apparatuses 11 configured for providing interaction of the users 10 with the network entities 101 representing an external (i.e., "cloudy") system environment of the interface apparatuses 11. It should be understood that any desired number of the interface apparatuses 11 may be associated with one user 10, although for simplicity of illustration, only one interface apparatus 11 associated with one user 10 (e.g., with a child) is explicitly shown in FIG. 1. For the purpose of the present application, the term "network entity" refers to an external (e.g., "cloudy") source and/or a recipient of data signals from the interactive interface apparatus 11 of the present invention over a communication network 102. The network entities 101 can, generally, represent people, organizations, and services using various communication platforms, computer systems, other interface apparatuses, and other communication systems that can communicate with the interface apparatus 11. For example, as shown in the example shown in FIG. 1, the network entities 101 include various service systems (indicated by a reference numeral 101*a*) configured for control, configuration, diagnostics and support of the system 100. The network entities 101 also include various service systems 101*b* configured for organization and conduction of natural language dialogs with the user 10, as well as for providing remote monitoring, diagnostics, etc. The network entities 101 also include a supervisor communication system 101*c* operated by the user's supervisors, (e.g., by parents), and a peer communication system 101*d* operated by the user's peers (e.g., by friends).

The network entities 101 of the system 100 can be implemented through any suitable combinations of hardware, software, and/or firmware; and include computing devices communicating with interface apparatus 11 via the communication network 102. Further, as will be described hereinbelow, the network entities 101 may be communicably linked to various requirements databases (not shown), and access data stored in these databases. The network entities 101 may be servers operating on network 102, and may be operated by a common entity (not shown) having a set of requirements or architecture for compliance. It may be appreciated by one skilled in the art that the databases may be directly communicably linked to the network entities 101, or may be communicably linked to the network entities 101 through the network 102. When desired, the network entities 101 may, for example, be implemented as servers that are configured to operate data mining tools, and to permit access to the information stored in the databases. The network entities 101 may, for example, be associated with personal computers, workstations. When desired, one or more network entities 101 may be associated with suitable handheld devices, such as Personal Digital Assistant (PDA) devices, cellular telephones, or any other devices that are capable of operating, either directly or indirectly, on the network 102. The communication network 102 may, for example, be implemented as an external global network, such as the Internet. It may further be appreciated that alternatively, the network 102 may also be implemented as any local or wide area network, either public or private. The communication network 102 can also be a combination of global and local networks.

Although the interface apparatus 11 of the present application is described hereinbelow mainly in application to children and young users, it should be understood that adults can also utilize this apparatus, and thus benefit from the advantages provided by the present invention.

According to an embodiment of the present invention, the interface apparatus 11 can be realized in the form of an interactive children's toy, such as stuffed animals, dolls, toy robots or any other figurines, however other implementations are also contemplated. For example, when desired, the interface apparatus 11 can be implemented in the form of a smart baby carriage or stroller. The interface apparatus 11 can be realized in the form of a baby cot, as well as in the form of a specialized garment for children.

The interface apparatus 11 includes electronic components arranged within the figurine body, and are implemented as a computer system including hardware, software, and/or firmware configured for communication of the user 10 with the network entities 101. In particular, the hardware (not shown) is configured as a system including such main component as a central processing unit (CPU), a main memory (RAM), a read only memory (ROM), an external memory, etc. The processor is preprogrammed by a suitable software model capable of analyzing the user input information from the user and the user state information related to a state of the user and relaying this information to the external network entities 101. The software model is also configured for providing user information output signals to the interface apparatus from the external network entities 101 as a reaction to the user input information. The software can be stored in the ROM, a rewritable persistent storage device like a hard disk, a solid state memory device like a flash memory, an external memory device or the like, and when required can be loaded into the RAM, and executed by the processor. Accordingly, the processor can perform a number of data processing steps, calculations, or estimating functions, some of which will be discussed hereinbelow. It should also be understood that the present invention further contemplates a machine-readable memory tangibly embodying a program of instructions executable by the machine for executing the method of the invention.

Figure 2:
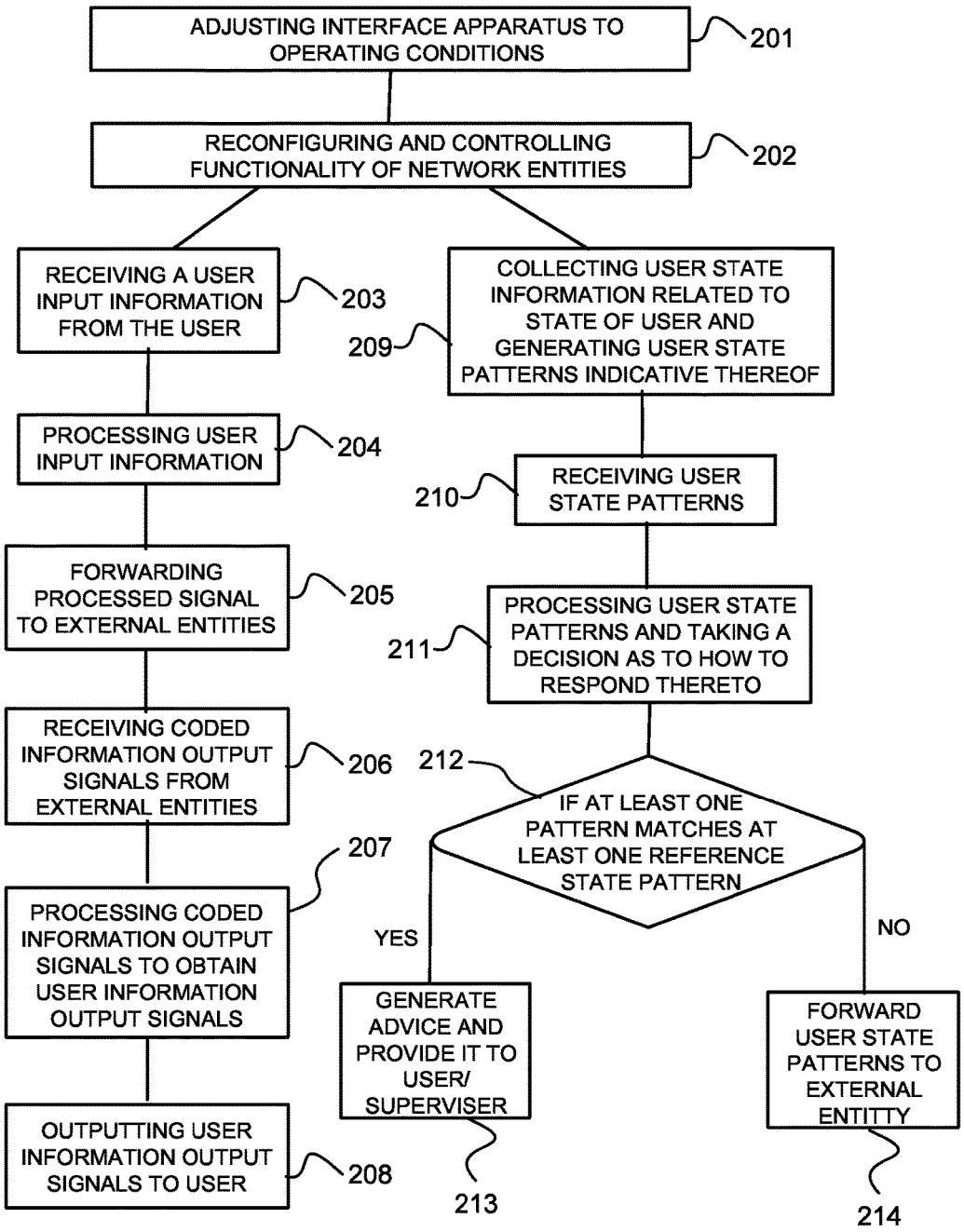
FIG. 2 illustrates a schematic flowchart diagram of a method for providing interaction of users with a plurality of network entities over a communication network by the interface apparatus of FIG. 1 configured to provide the interaction between a user and a plurality of network entities cooperating with said interface apparatus under a predetermined agreement, in accordance with an embodiment of the present invention.

FIG. 2 illustrates a schematic flowchart diagram of a method for providing interaction of users with a plurality of network entities 101 over a communication network 102 by the interface apparatus 11 configured to provide interaction between a user and a plurality of network entities cooperating with said interface apparatus under a predetermined agreement, in accordance with an embodiment of the present invention. The predetermined agreement can, for example, be established between a customer (e.g., an owner or user of the interface apparatus 11) and a provider of certain cloud services associated with the network entities 101.

Referring to FIGS. 1 and 2 together, the method includes adjusting (block 201) the interface apparatus 11 to operating conditions in the communication network 102 in accordance with the predetermined agreement, and reconfiguring and controlling functionality (block 202) of the network entities 101 for adjusting operation of the network entities to predetermined requirements imposed on the external entities for interaction with the interface apparatus. In particular, the network entities 101 can generally have extended functionality, and be capable to provide some features which are not required to the user. Accordingly, the interaction of the interface apparatus 11 with these entities can be adjusted by selecting only those functions of the network entities 101 which are assigned to the user in the agreement.

According to one embodiment of the present invention, the method also includes (see block 203) receiving user input information from the user, processing (see block 204) this user input information and forwarding (see block 205) the corresponding processed signal to one or more external entities 101 configured for handling communication with the user and generating coded information output signals.

The method further includes receiving (see block 206) coded information output signals from the external entities 101, and processing (see block 207) thereof to obtain user information output signals in a format suitable for outputting (see block 208) to the user through a speaker and/or display that can be provided with the interface apparatus.

According to another embodiment of the present invention, the method includes collecting (block 209) user state information related to a state of the user and generating user state patterns indicative of the state of the user. Then, the method further includes receiving (block 210) the user state patterns, processing (block 211) thereof by comparing the user state patterns with reference state patterns stored in the interface apparatus and taking a decision as to how to respond to the received user state patterns. The reference state patterns are indicative of various predetermined states of the user and can be used as a reference for determining a monitored state of the user.

According to one embodiment of the present invention, if at least one of the user state patterns matches (block 212) at least one reference state pattern stored in the interface apparatus, the decision is to generate (block 213) the coded information output signals that includes advice indicative of reaction on the monitored state of the user 10 and to process the coded information output signals for decoding thereof in order to extract the advice, and to output the advice to the user 10.

According to another embodiment, if at least one of the user state patterns matches a certain predetermined reference state pattern stored in the interface apparatus, the decision can be to send a notice to one or more external entities (e.g., to the parents) with information on the fact of revealing this pattern.

According to one embodiment of the present invention, if none of the user state patterns matches at least one reference state pattern, the monitored user state patterns are forwarded (block 214) to a corresponding at least one external entity 101 configured for handling the user patterns.

According to some embodiments, one or more external entities 101 can be configured for receiving coded information input signals from the interface apparatus 11, analyzing the coded information input signals and generating the coded information output signals indicative of reaction on the coded information input signals, and relaying the coded information output signals to the interface apparatus.

According to some embodiments, one or more external entities 101 can be configured for receiving user state patterns from the interface apparatus 11, analyzing the user state patterns and generating said coded information output signals indicative of reaction on said coded information input signals, and relaying the coded information output signals to the interface apparatus 11.

According to some embodiments, one or more external entities 101 can be configured for receiving from the interface apparatus 11 coded information input signals, providing analysis thereof for identifying various situations occurring with the user 10, finding a communication device of a supervisor (e.g., a parent) of the child user, and providing communication of the supervisor communication device with the interface apparatus 11 of the user 10.

According to some embodiments, one or more external entities 101 can be configured for receiving user state patterns from the interface apparatus 11, providing analysis thereof for identifying various situations occurring with the user, finding a communication device of a supervisor (e.g., a parent) of the child user, and providing communication of the supervisor communication device with the interface apparatus of the user 10.

According to some embodiments, one or more external entities 101 can be configured for receiving coded information input signals from the interface apparatus, finding an interface apparatus used by a peer (e.g. a friend) to the user, and providing communication between the interface apparatus of the user and said at least one another interface apparatus.

Figure 3:
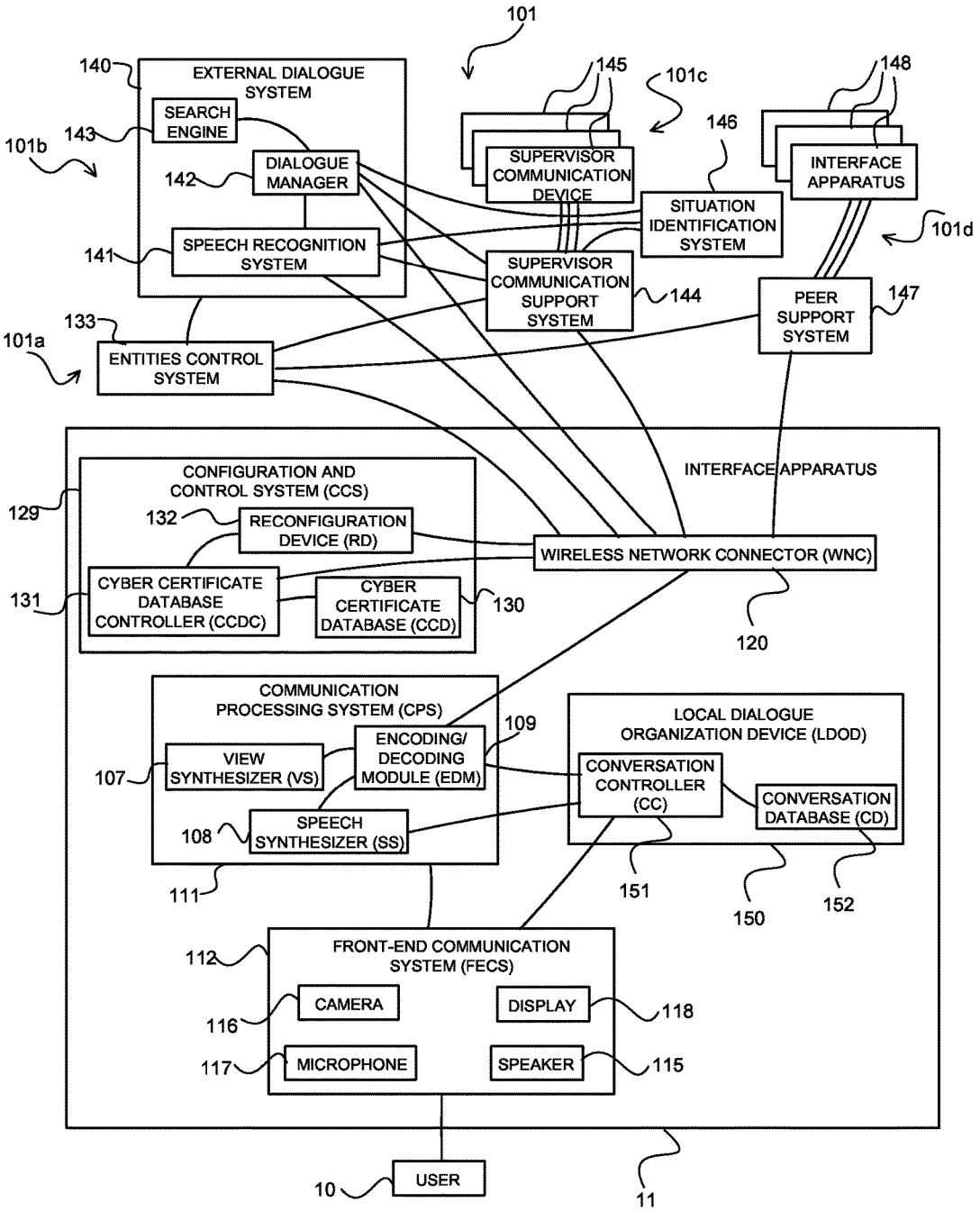
FIG. 3 illustrates a more detailed schematic block diagram of the system of FIG. 1 configured for providing interaction of users with a plurality of entities over a communication network, according to one embodiment of the present invention.

Referring to FIG. 3, a more detailed schematic block diagram of the system (100 in FIG. 1) for providing interaction of users with a plurality of network entities 101 over a communication network is illustrated, according to an embodiment of the present invention. According to this embodiment, the interface apparatus 11 includes a communication section including a front-end communication system 112 having a set of devices for audio and visual interaction of the apparatus 11 with the user 10, a communication processing system 111 coupled to the front-end communication system 112, a configuration and control system 129, and a wireless network connector 120 electrically coupled to the configuration and control system 129 and to the communication processing system 111.

The term "front-end" is used in the present application to characterize devices, program interfaces and/or services relative to the initial user 10 of these devices. According to this definition, all the devices program interfaces and/or services employed in the network entities 101 are referred to as "back-end" devices.

According to an embodiment, the wireless network connector 120 is configured for providing a wireless signal linkage between the interface apparatus 11 and the plurality of network entities 101 over the communication network 102. The wireless network connector 120 can be any suitable device implemented through any suitable combinations of hardware, software, and/or firmware.

According to an embodiment of the present invention, the front-end communication system 112 includes one or more front-end communication input devices (CID) configured for interaction with the user 10 for receiving user input information from the user, and generating user information input signals. The front-end communication system 112 can also include one or more front-end communication output devices (COD) configured for interaction with the user 10 for audio outputting and/or video outputting user information output signals obtained as a reaction to the user input information. The user information output signals can, for example, originate from the decision-making system 114, as will be described hereinbelow in detail. Likewise, the user information output signals can be targeted to the user from the corresponding network entities 101 through the communication network 102.

According to an embodiment, the front-end communication system 112 includes such a front-end communication input device (CID) as a microphone 117 configured for receiving the user input information provided verbally (i.e., a user utterance), and converting the user information into the user information input signals corresponding to the user verbal input information. When desired, the front-end communication system 112 can also include such a front-end communication input device (CID) as a video camera 116 configured for receiving the user information provided visually (i.e., a user image) and converting the user information into the user information input signals corresponding to the visual user information.

According to an embodiment, the front-end communication system 112 includes such a communication output device (COD) as a speaker 115 configured for audio outputting the user information output signals. Moreover, when desired, the front-end communication system 112 can include such a communication output device (COD) as a display 118 configured for video outputting the user information output signals. The user information output signals can, for example, be indicative of reaction of the decision-making system 114 or the corresponding network entities 101 to the user information input signals.

When the interface apparatus 11 is implemented in the form of an interactive stuffed animal or a doll, the microphone 117 may, for example, be disposed in the toy's ears, the video camera 116 may, for example, be disposed in the eyes of the toy's face, the display 118 may, for example, be disposed on the body of the toy, and the speaker 115 may, for example, be disposed in the toy's mouth.

When desired, the communication output device (COD) may also include any other presentation devices configured for interaction with the user 10 to provide output information to the user in a sensual and visual manner, mutatis mutandis. Exemplary presentation devices include, but are not limited to, vibrating components, light emitting elements, motion providing elements associated with suitable motors configured for providing motion to various body parts of the interactive toy, etc.

According to an embodiment, the communication processing system 111 includes an encoding and decoding module 109 coupled to the front-end communication input devices (CID) and to the front-end communication output devices (COD).

The encoding and decoding module 109 is configured for receiving the user information input signals, such as audio and video signals generated by the microphone 117 and by the video camera 116, correspondingly, for coding these signals to a format suitable for data transfer, and for relaying coded information input signals to the wireless network connector 120 for forwarding the coded information input signals to one or more network entities 101 configured for handling communication with the user over the communication network.

The encoding and decoding module 109 can be implemented through any suitable combinations of hardware, software, and/or firmware. A digital data stream at the output of the encoding and decoding module 109 may be encoded using any of the existing audio and video coding standards. For example, the data stream can be encoded using the following standards: MPEG-4 Visual codec, h. 264, VP8, etc., for video signal provided by the built-in video camera 116, and MP3, AAC, Vorbis, etc to encode the audio signal provided by the microphone 117.

According to an embodiment, the communication processing system 111 is also configured for receiving coded information output signals provided by network entities 101 through the wireless network connector 120 by the encoding and decoding module 109, and for decoding these signals to obtain the user information output signals in a format suitable for outputting by the corresponding communication output devices.

According to an embodiment, the communication processing system 111 includes a speech synthesizer 108 coupled to the encoding and decoding module 109 and to the speaker 115. The speech synthesizer 108 is configured to receive decoded information output signals, and to generate electrical signals in a format suitable for audio outputting thereof by the speaker 115. Likewise, when desired, the electrical signals generated by the speech synthesizer 108 can be encoded by the encoding and decoding module 109 and transmitted to the corresponding network entities 101 through the communication network 102.

The decoded signals that are fed to the speech synthesizer 108 can generally be presented in different formats, for example, it can be a string of text that should be audio outputted by the speaker 115. The user information output signals can, for example, be received by the encoding and decoding module 109 in a coded form from the corresponding entities 101 through the communication network 102. Moreover, as will be described hereinbelow, the user information output signals can be generated by the corresponding module included in the interface apparatus 11.

According to a further embodiment, the communication processing system 111 includes a view synthesizer 107 coupled to the encoding and decoding module 109 and to the display 118. The view synthesizer 107 is configured to receive the decoded signals from the encoding and decoding module 109 and to generate electrical signals in a format suitable for video outputting thereof by the display 118.

For example, the speech synthesizer 108 and the view synthesizer 107 can be conventional systems implemented in hardware and included in a customized microchip. Alternatively, the speech synthesizer 108 and the view synthesizer 107 can be realized as hardware and software integrated solutions that represent a set of algorithms for speech and image synthesis, and a hardware computing platform to run the algorithm data and convert the results into electrical audio and video signals which are relayed to the speaker 115 and to the display 118, correspondingly.

According to an embodiment of the present invention, a local dialog organization device 150 is included in the interface apparatus 11 for providing a dialog between the user 10 and the interface apparatus 11. The local dialog organization device 150 can be coupled to the speech synthesizer 108 of the communication processing system 111 and to the speaker 115 of the front-end communication system 112. The local dialog organization device 150 generally includes a conversation controller 151 coupled to the speech synthesizer 108, and a conversation database 152 coupled to the conversation controller 151 information output signals. The conversation controller 151 is configured for receiving a user utterance from the microphone 117 in the form of a user information input signal, analyzing the user information input signal, retrieving an information output signal including an answer that corresponds to the user utterance sentence from the conversation database information output signals 152, relaying the information output signal to the speech synthesizer 108 and outputting this answer to the user via the speaker 115. Construction and operation of speech recognition and conversation techniques are generally known in the art (see, for example, U.S. Pat. Nos. 7,016,8849; 7,177,817; 7,415,406; 7,805,312; 7,949,532; the description of which is hereby incorporated in its entirety by reference); and therefore will not be expounded hereinbelow in detail.

It should be noted that the local dialog organization device 150 can, for example, be used in the case when relatively simple dialogs between the user and the interface apparatus are conducted, and when no access to the communication network 102 is available. If the questions are sophisticated and require special knowledge that is not included in the database 152 of the local dialog organization device 150, the interface apparatus 11 can address this question to the corresponding external network entity for handling this request, as will be described hereinbelow in detail.

Figure 4:
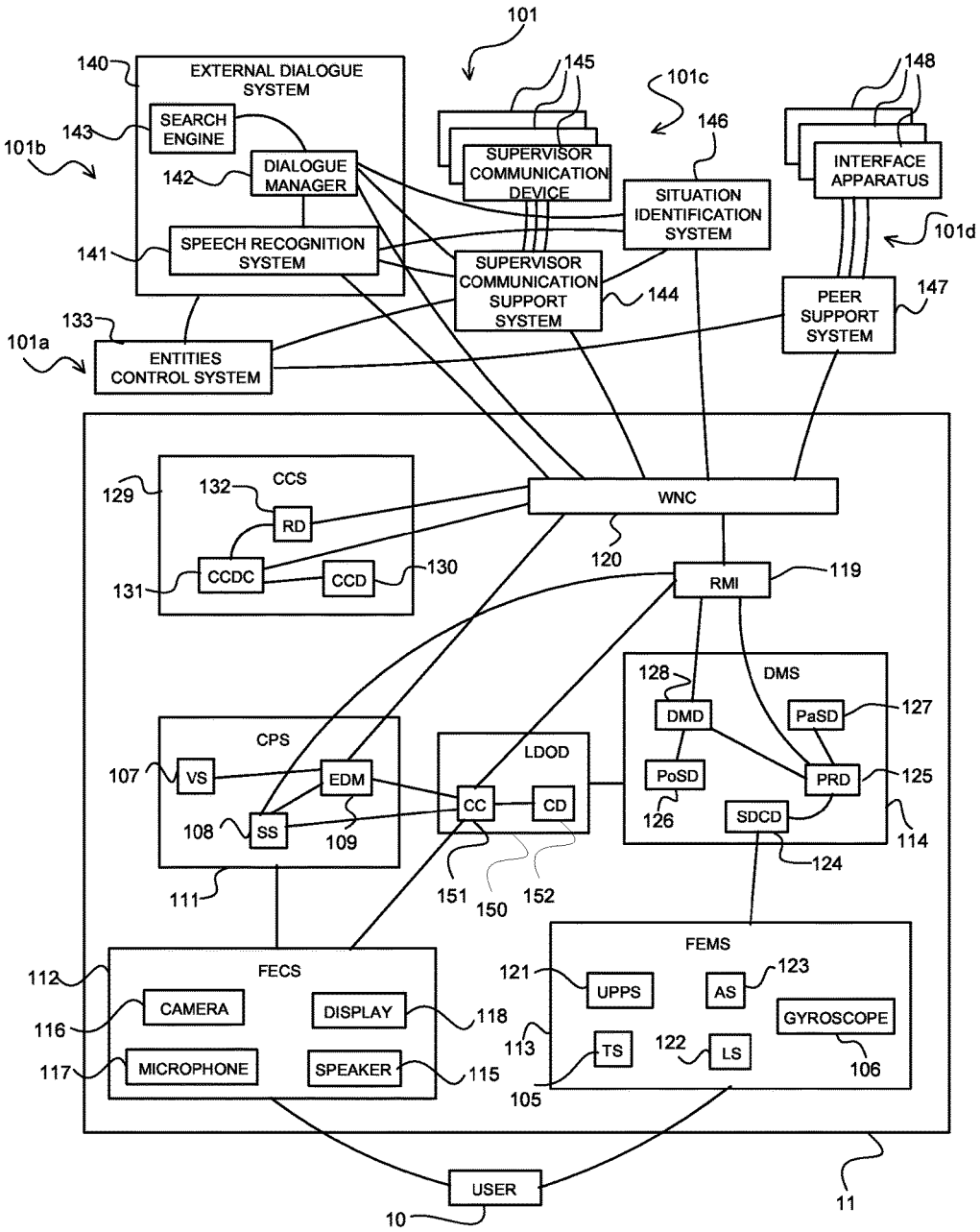
FIG. 4 illustrates a more detailed schematic block diagram of the system of FIG. 1 configured for providing interaction of users with a plurality of entities over a communication network, according to another embodiment of the present invention.

Referring to FIG. 4, a schematic block diagram of the system for providing interaction of users with a plurality of network entities 101 over a communication network is illustrated, according to another embodiment of the present invention. According to this embodiment, the interface apparatus 11 differs from the interface apparatus shown in FIG. 3 due to the fact that the interface apparatus shown in FIG. 4 further includes a monitoring section in addition to the communication section. The monitoring section includes a front-end monitoring system 113 having a set of devices for monitoring vital signs of the user 10, a decision-making system 114 coupled to the device monitoring system 113, and an interface for remote monitoring (RMI) 119 coupled to the decision-making system 114. The interface for remote monitoring (RMI) 119 is also coupled to the wireless network connector 120, to the communication processing system 111, and to the local dialog organization device 150.

According to an embodiment of the present invention, the front-end monitoring system 113 of the interface apparatus 11 includes one or more front-end monitoring devices (MD) configured for interacting with the user 10 in order to collect user's characteristics. The user's characteristics can, for example, include user state information related to a state, location and current activity of the user 10. The front-end monitoring devices are also configured for generating user state patterns, which are data signals indicative of the user's characteristics, and variations of these data signals. For example, the monitoring devices MDs include various types of sensors to gather information about such user's parameters as a current state of the child, location, the current activity of the child and his or her interactions with a smart interface 11, etc. When the interface apparatus 11 is implemented in the form of an interactive stuffed animal or a doll, the front-end monitoring devices may, for example, be disposed at the limbs with arms and legs to imitate animal and humanoid touching.

According to an embodiment, the front-end monitoring system 113 includes a tactile sensor 105 configured to provide the user state information which is indicative of a force applied by the user 10 to the interface apparatus in the place where the tactile sensor 105 is located. The sensor signals provided by the tactile sensor 105 can, for example, be used in the interface apparatus 11 in conjunction with signals from other sensors in order to detect the patterns of different situations. In particular, when the interface apparatus is configured for a child user, the sensor signals provided by the tactile sensor 105 can be used in order to detect the patterns of gaming situations, for example, when the child catches a toy interface apparatus that falls to the floor.

The tactile sensor 105 can, for example, be based on different physical principles, such as piezoresistive, piezoelectric, capacitive, resistive, etc. It should be understood that when required, tactile sensor 105 can include several tactile sensor probes located physically in different parts of the apparatus.

According to an embodiment, the front-end monitoring system 113 includes one or more user physiological parameter sensors 121 configured for measuring at least one vital sign of the user 10. Examples of the user physiological parameter sensors 121 include, but are not limited to, a temperature sensor (not shown), a pulse rate sensor (not shown), a blood pressure sensor (not shown), a pulse oximetry sensor (not shown), and a plethysmography sensor (not shown), etc. It should be understood that front-end monitoring system 113 may also include any other suitable monitoring devices related to characteristics of the user. Examples of the vital signs of the user 10 which can be monitored by the front-end monitoring system 113 include, but are not limited to, temperature, heart rate, heart rate variability, arterial pulse waveform, systolic blood pressure, diastolic blood pressure, mean arterial blood pressure, pulse pressure, breathing rate, blood oxygen saturation, total hemoglobin content and/or anaerobic threshold monitoring, etc.

According to an embodiment, the front-end monitoring system 113 includes a user location sensor 122 configured for determination of a location of the interface apparatus 11. Examples of the user location sensor 122 include, but are not limited to, a GPS-based positioning system (i.e., GPS receiver), and various other global positioning systems, such as Russian Global Navigation Satellite System (GLONASS), Indian Regional Navigational Satellite System (IRNSS), European Global Navigation Satellite System (Galileo), Chinese Global Navigation Satellite System (COMPASS), Ekahau Real Time Location System (RTLS), etc. Likewise, a user location sensor 122 can use signals of a cellular network, Wi-Fi, or any other suitable network.

According to an embodiment, the front-end monitoring system 113 includes an accelerometer sensor 123 configured for converting the change in velocity (acceleration) of the interface apparatus into an electrical signal in order to detect the variation of motion of the interface apparatus 11.

According to an embodiment, the front-end monitoring system 113 includes a gyroscope 106 producing an electrical signal, which characterizes the changes of orientation of the interface apparatus 11 in space.

The use of the accelerometer 123 together with the gyroscope 106 and the location sensor 122 enables obtaining of the patterns corresponding to motor activity of the user (when, for example, when a child user is playing with the toy interface apparatus) and also recognizing various situations related to the user (for example, the child is sitting, running, falling down, etc).

According to an embodiment of the present invention, the decision-making system 114 is coupled to the front-end monitoring system 113 and is configured for receiving the user state patterns collected by the front-end monitoring devices MDs, and processing these patterns for taking a decision as to how to respond to the received user state patterns.

According to an embodiment, the decision-making system 114 includes a sensor data collection device 124 configured for receiving the user state patterns measured by the front-end monitoring system 113 and formatting these signals for further processing. The decision-making system 114 also includes a pattern recognition device 125 coupled to the sensor data collection device 124, a pattern storage device 126 coupled to the pattern recognition device 125, a decision maker device 128 coupled to the pattern recognition device 125, and a policy storage device 127 coupled to the decision maker device 128. The policy storage device 127 includes a policy decision database (not shown) storing the policies for taking decisions responsive to the patterns received from the front-end monitoring devices MDs.

According to one embodiment of the present invention, the sensor data collection device 124 in operation collects data from the front-end monitoring devices MDs through their periodic survey (polling) in accordance with a predetermined time schedule. In this embodiment, the sensor data collection device 124 may include a Scheduler module (not shown) that can, for example, be a software component which regulates the time schedule of the periodic survey of all the front-end monitoring devices MDs with a purpose to update the collected data. The sensor data collection device 124 may further include an Aggregation and Data Formatting module (not shown) that can, for example, be a software component that carries out integration (aggregation) of the data collected from the front-end monitoring devices MDs and prepares these data by corresponding formatting for the pattern recognition device 125. The sensor data collection device 124 may also include a Polling module (not shown) that can, for example, be a software component that carries out the periodic survey of the front-end monitoring devices MDs according to the schedule established by the Scheduler module, and relays the resulting data to the Aggregation and Data Formatting module for further processing.

According to another embodiment of the present invention, the collection of data from the front-end monitoring devices MDs is based on so-called interruptions. According to this embodiment, the sensor data collection device 124 includes an Interruption module (not shown) that can, for example, be a software component that provides interruptions of the signals relayed to sensor data collection device 124 from the front-end monitoring devices MDs. In operation, as soon as the changes in measuring parameters are registered by one or more front-end monitoring devices MDs, system interruptions are generated in which the control is transferred to the Aggregation and Data Formatting module. Thus, the Aggregation and Data Formatting module receives data from all the front-end monitoring devices MDs, as they become available. As mentioned above, the Aggregation and Data Formatting module provides aggregation of the data collected from front-end monitoring devices MDs and preparing (formatting) these data for the pattern recognition device 125. The data at the output of the sensor data collection device 124 can, for example, be presented in a tree structure, which is expressed by known markup languages, such as XML, JSON, etc.

The pattern recognition device 125 is configured for collating the user state patterns with reference state patterns stored in the interface apparatus, and generating an identification signal indicative of whether at least one of the user state patterns matches or does not match at least one reference state pattern. In this case, the reference state patterns are indicative of various predetermined states of the user, and are used as a reference for determining a monitored state of the user. The pattern recognition device 125 provides analysis of the data received from the front-end monitoring devices MDs. The analysis is carried out within the smart interface apparatus 11 itself, i.e., without a requirement for additional analytical cloud services available through the Internet.

The data analysis is carried out for the purpose of recognition and identification of various situations occurring during the user's interactions with the interface apparatus 11. Detection and identification of the various situations is carried out by collating the user state patterns with the reference patterns which are known in advance and stored in the pattern storage device 126. The pattern storage device 126 includes a reference pattern database (not shown) of the reference patterns corresponding to the various situations associated with the user in which these patterns may appear. Identification of the patterns is carried out by matching the measured pattern (including the pattern measured in a historical perspective) provided in a flow to the pattern recognition device 125 through the sensor data collection device 124, to the reference patterns provided to the pattern recognition device 125 from the pattern storage device 126.

According to an embodiment, the database of the reference patterns can include a file (or a set of files) in the file system, describing the patterns in a particular format.

According to another embodiment, the database of the reference patterns can include a subsystem based on existing relational database management systems (RDBMS), such as Oracle (e.g., Oracle Express Edition), MySQL, SQLite, PostgreSQL, Informix, etc.

According to a further embodiment, the reference pattern database may be based on object-oriented databases and graph databases based on network organization of data objects as graphs with complex structures that have Small-World properties, known per se.

The reference patterns may have a different internal structure and can be presented in different formats, depending on how the patterns are stored. For example, in the case when the patterns are stored either in the form of graph databases or in the form of simple files in the file system, the patterns can be data objects which have tree-like internal structure and which are implemented, inter alia, by means of XML, JSON, and some other languages.

The measured user state patterns reflect variations of one or several characteristics of a user. For example, the pattern may reflect deviation of the temperature of the user's body from the normal temperature that can be captured by a temperature sensor that is included in the set of physiological parameter sensors 121. In particular, the increase of the body temperature above a certain temperature threshold (e.g., +37° C.), may be interpreted as suspicion for the presence of a particular sickness of the child, e.g. a cold or inflammation in the child's body.

Another example of the measured user state patterns is a pattern received by the location sensor 122. This pattern may be the deviation of the coordinates of the current location of the child from a certain place. Likewise, the pattern may be the deviation of the user's coordinates from a specified route (for example, the route from home to school and back) or deflection of the user's coordinates from the coordinates of the specified area (for example, from the coordinates of the playground that is next to the house of the child).

When desired, more complicated situations can be detected and identified by monitoring various complex patterns that may be received concurrently from several sensors.

According to an embodiment, the measured user state patterns can be associated with certain situations that can occur during interactions of the user with the interface apparatus. These situations can, for example, be described as data objects that refer to the patterns corresponding to these situations. Several patterns can correspond to the certain situation, which can be present concurrently or as a chain of events.

An example of how several interconnected patterns lead to the discovery of a certain situation may be illustrated on a procedure for detection of variations in the emotional state of the child. The interface device can for example, identify and register the situation, indicating the presence of a bad temper in the child, such as aggression, depression, crying, etc. The identification can be carried out by the identification of the relevant data patterns based on the analysis of the nature of the dialog with the child, for example, use of aggressive words in the dialog, interruption of the conversation, etc. Moreover, the identification can use the analysis of the emotional character of the child's speech, since the pace and intonation of the speech can indicate aggression, depression, etc. Likewise, an analysis of the video image of the child taken with the built-in video camera can be used for the identification of the emotional state of the child. In this case, the identification may be based on the analysis of the pupils of the child's eyes, his facial expression, gestures and body movements during the detection, etc.

When desired, a model with more complex interrelated situations can be built. For example, when the detected patterns indicate the presence of the child's bad mood (irritability, depression, etc.) and this type of the child's behavior differs from his regular behavior for similar time periods in the past (for example, a child today cries and gets irritated more than usual in the past), there is a suspicion of the existence of variations in the state of the child's health. If there is suspicion of the existence of variations in the health state of the child, the interface apparatus can initiate measurements of the child's physiological parameters, for example, his body temperature, and if this temperature is not normal, the interface makes conclusions that the child is sick and takes appropriate actions. Thus, the patterns indicating a bad mood of the child can be linked with patterns indicating his health changes.

The patterns and the interaction between them can be described as a data object that can contain its unique identifier that allows distinguishing of a certain situation from many others. Such a unique identifier is an attribute of data, and can be presented in different formats, for example, it can be an arbitrary string of text containing a unique set of characters. Likewise, the unique identifier can be a number, or a globally-unique identifier (Globally Unique ID or GUID), etc.

Forming and updating the database of reference patterns of the pattern storage device 126 can be carried out in a number of ways. For example, a description of the situations and the reference patterns associated with these situations can be transmitted to the database of the reference patterns from those network entities 101 which are dedicated for this purpose. The transmission can be carried out via the Internet, then via the wireless network connector 120, then via the interface for remote monitoring 119 and also via the pattern recognition device 125. In this case, updates of the reference patterns in the database can be handled by the configuration and control system 129, as will be described hereinbelow.

According to another example, the updating of the reference patterns in the database of the pattern storage device 126 can be carried out by teaching the interface apparatus by the user of this apparatus. In particular, in the case of occurrence of a certain situation, the user (i.e., the child or a parent of the child) indicates occurrence of this situation, provides an identification name to this situation, and requests the interface apparatus, (e.g., a child's toy) to memorize this situation by storing the corresponding pattern in the database of the pattern storage device 126. All the interactions with the interface apparatus can be conducted in the form of a dialog in a natural language.

After receiving an instruction from the user to store a pattern, the interface apparatus 11 defines the situation, records the changes for all the parameters of the sensors at the time when this situation occurred, automatically generates a description of the corresponding pattern, associates the corresponding situation with this pattern, and adds the pattern with the corresponding description into the database of the pattern storage device 126.

In operation, if the pattern recognition device 125 identifies a correlation between the user state patterns and at least one reference pattern corresponding to a certain situation related to the user, an identification signal is generated indicative of the corresponding situation that is associated with the given pattern. This identification signal is then relayed to the decision maker device 128 for taking a decision in accordance with a predetermined policy associated with this situation.

Alternatively, if none of the user state patterns matches at least one reference state pattern stored in the database of the pattern storage device 126, the pattern recognition device 125 can forward these monitored user state patterns via the interface for remote monitoring 119 to the corresponding network entity that is configured for handling such user patterns.

It should be understood that various known algorithms can be used for analysis of the pattern data received from the sensor data collection device 124 for identification of correlations of the patterns obtained from the user with the reference patterns. In particular, such algorithms can take into account the statistical characteristics of the data, and to analyze the data in their historical (chronological) perspective and consider how these data were changed at certain time periods in the past.

Moreover, various search algorithms based on a fuzzy logic can be used. Such algorithms conduct a fuzzy match with the specified pattern with a certain degree of proximity to the reference pattern. This provision enables identification of the user patterns despite all kind of obstacles, such as fluctuations of data, errors in measurement, noise, etc.

The decision maker device 128 is configured for receiving an identification signal from the pattern recognition device 125, and in response to the identification signal, searching a suitable policy in the policy decisions database of the policy storage device 127 for taking the corresponding decision responsive to the received patterns. The policy includes instructions for taking the suitable decision as to how to respond to the measured user state pattern.

According to an embodiment of the present invention, the decision maker device 128 is also configured for relaying instructions indicative of the suitable policy either to the local dialog organization device 150 for organizing a dialog between the user and the interface apparatus or to the network entities 101 cooperating with the interface apparatus for handling thereof.

As described above, the local dialog organization device 150 can be configured for organization of a dialog between the user 10 and the interface apparatus 11 when the decision maker device 128 sends corresponding information output signals to the communication processing system 111 to employ a voice dialog with the user for outputting suitable advice to the user which would be responsive to the measured user state pattern.

Thus, the policy decision database of the policy storage device 127 includes a set of decisions, the corresponding advice and instructions in connection with the actions that should be carried out in the case of detection and identification of a certain situation related to the corresponding pattern(s) received from the front-end monitoring devices of the front-end monitoring system 113. The set of decisions, for example, may include a decision to communicate with a child's parent and to send to the parent a notice and/or alert of the occurrence of certain situations. The alert may include information that the child left the territory of a certain playground and provide data on the child's current location. Likewise, the alert may include information associated with the track of a child's movements, such as the child fell down from a certain height (e.g., a bed, a table, etc). Moreover, the notice/alert may include information about the physiological and emotional state of the child, such as a crying, fever, etc.

When required, in the case of critical situations that represent a threat to the life and health of the child, the set of decisions may include the decisions to place a corresponding call automatically to an emergency rescue service (with a simultaneous notification to the parents of critical situations).

When required, the set of decisions may include a decision to generate and send the corresponding user information output signals to the communication processing system 111 of the interface apparatus to perform certain actions. For example, when the front-end monitoring system 113 provides signals indicative of depressed or dissatisfied emotional states of the user (e.g., the child is crying), the decision maker device 128 may send corresponding information output signals to the communication processing system 111 to employ a voice dialog with the child, which may be conducted in a specific form with certain specified words in replicas for soothing the child providing the text of the dialog. When desired, the dialog may be provided with a suitable intonation and a voice timbre. An example of the system capable of changing voice patterns according to a user's status and is suitable for the purpose of the present application is described in U.S. Pat. No. 8,123,615, the description of which is hereby incorporated in its entirety by reference.

Further, the set of decisions may include a decision to send instructions to one or more network entities that cooperate with the interface apparatus to provide suitable cloud services to the user. The instructions may, for example, include commands for automatic reconfiguration and control of the functionality of the network entities so as to adjust their operation to cooperate with the interface apparatus for a desired interaction with the child. For example, as will be described hereinbelow in detail, the decision maker device 128 can control a corresponding network entity responsible for conducting dialogs with the user, that upon receiving the notification that the child is crying, can be adjusted on the fly to generate replicas for soothing the child in addition to that replicas which are generated by the interface apparatus itself, by adapting not only the text of the dialog, but also a voice timbre, intonation and pace of the delivered speech, etc.

According to an embodiment of the present invention, when the interface apparatus is implemented in the form a children's toy, the front-end communication system may include light devices disposed on the body of the toy, motors associated with limbs of the toy, and also other devices that may indicate reaction of the toy on the user state patterns indicative of the emotional and physiological states of the user. Thus responsive to the user state patterns, the decision maker device 128 of the interactive toy interface apparatus may be configured for activation of one or several such devices in order to wink an eye, light a built-in light device, smile, lend an arm (or paw), change color, etc.

It should be understood that the policy storage device 127 and the pattern storage device 126 can be physically realized as two different storage devices. However, when desired, the policy decision database and the reference pattern database can share a common storage device integrating the policy storage device 127 and the pattern storage device 126 together, and be managed by a common database management system (not shown). The policy decisions may, for example, be represented by data objects having tree-like internal structure or other suitable internal structure similar to the database of the reference patterns.

As described above, the interface for remote monitoring 119 of the interface apparatus 11 is coupled to the communication processing system 111 of the communication section and to the decision-making system 114 of the monitoring section. According to this embodiment, the interface for remote monitoring 119 can provide interaction of the communication, monitoring and decision-making components of the interface apparatus 11 with the plurality of network entities 101 that provide cloud-based services through the communication network 102, e.g., through the Internet, etc.

According to an embodiment of the present invention, the interface for remote monitoring 119 is configured, inter alia, to provide support for data formats and protocols required for interaction with the external network entities 101. For example, for communication of the interface apparatus 11 with the plurality of network entities 101, the interface for remote monitoring 119 may use various protocols. Examples of suitable protocols include, but are not limited to, Hypertext Transfer Protocol (HTTP), Simple Object Access Protocol (SOAP), Secure Shell network protocol (SSH), Simple Network Management Protocol (SNMP), Session Initiation Protocol (SIP) and an expansion of SIP for instant messaging, etc.

As described above, the interface for remote monitoring 119 can also be coupled to the local dialog organization device 150. This provision enables the interface for remote monitoring 119 to provide a voice feedback from the interface apparatus 11 to one or more network entities requesting information about the user 10. The external entities can submit a query about the current state of the user, and to obtain a response to this query in a natural language. For example, the parents of the child user may apply to the interface toy apparatus 11 with a query about the current physiological and emotional state of the child, and in response to the query, a report about the user's characteristics provided by the sensor data collection device 124 can be generated by the interface for remote monitoring 119. Then, this report can be coded by using the speech synthesizer 108, and can be transferred to the parents as an audio stream.

Specifically, the providing of a voice feedback to the network entities includes preparing the requested information by the interface for remote monitoring 119 in the form of a text string. When preparing the answer to queries from network entities, the interface for remote monitoring 119 actively cooperates with the external dialog system 140, if the network communication is available. Alternatively, the interface for remote monitoring 119 cooperates with the local dialog organization device 142.

According to an embodiment of the present invention, the external dialog system 140 activates the speech recognition system 141 in order to converts the query from the voice into a format suitable for automated processing, in the simplest case, into a text string. This query is then processed in the interface for remote monitoring 119.

The processing includes identification of the type of the query and the requested characteristics. Then, on the basis of the data available from the front-end monitoring system and information on the matching patterns, a report is generated for this query. This report can be generated as a certain data object and may have a tree-like structure and be submitted in any of the known formats suitable for presentation of data in a tree-like structure, for example, in XML format, JSON format, etc. Then, depending on availability of the network communication, the report can be relayed either to the external dialog system 140 or to the local dialog organization device 142 for generation of a response to the query in a regular form, e.g., as a text string.

This text string is then relayed to the speech synthesizer 108 together with the address of the recipient of this information. The speech synthesizer 108, in turn, generates an audio stream that represents the voiced speech of the required information. Then, the audio stream is coded to a format suitable for data transfer by the encoding and decoding module 109. Thereafter, this coded audio stream is relayed to the wireless network connector 120 for forwarding to the recipient, for example, to a communication device 145 of a parent of the child user 10 or to another supervising network entity 101.

The wireless network connector 120 is configured for providing a wireless signal linkage between the interface apparatus 11 and said plurality of network entities (101 in FIG. 1) over the communication network 102. The wireless network connector 120 can include various communication modules (not shown) that support interaction using an IP Protocol, for example Wi-Fi protocols including the 802.11 family (such as 802.11a, b, g, n, ac, ad), communication modules using cellular standards, such as GSM (including GPRS and EDGE), UMTS, LTE, Wi-MAX and other wireless standards and protocols. Moreover, the wireless network connector 120 can include local wireless communication tools, such as Bluetooth, ZigBee, NFC, etc.

As described above, the interface apparatus 11 includes the configuration and control system 129 that is coupled to the wireless network connector 120. The configuration and control system 129 can be implemented through any suitable combinations of hardware, software, and/or firmware, and is configured for automatic configuration, reconfiguration and control of functionality of the interface apparatus 11 for adjusting the interface apparatus to operating conditions of the communication network 102. The configuration and control system 129 is also configured for automatic reconfiguration and control of functionality of one or more network entities 101, so as to adjust operation of the network entities to the predetermined requirements imposed on the network entities for the desired interaction that cooperate with the interface apparatus. Furthermore, by using dynamically (on the fly) the external and internal functions of the interface apparatus, the configuration and control system 129 can provide automatic adaptation of the interface apparatus to the changing operating conditions (e.g., to the presence or absence of network access).

According to an embodiment of the present invention, the configuration and control system 129 is also involved in adaptation of the systems and devices of the external network entities that provide various services, to the terms of agreement between the providers of these services and their client, such as the user of the smart interface apparatus, on the quantity and quality of the services.

According to an embodiment of the present invention, the configuration and control system 129 includes a reconfiguration device 132 configured for dynamic reconfiguration of functionality of the interface apparatus 11, a cyber certificate database controller 131 coupled to the reconfiguration device 132 and a cyber certificate database 130 coupled to cyber certificate database controller 131.

According to an embodiment of the present invention, the reconfiguration device 132 is configured to control automatic configuration of functions of the interface apparatus 11 and operation of the external network entities that interact with the interface apparatus 11. Control can be carried out dynamically (on the fly) by controlling operation of the internal devices of the interface apparatus and functions of the external network entities for desired interaction with the interface apparatus.

In particular, in operation, the reconfiguration module 132 provides automatic adaptation of the interface apparatus 11 to changing network conditions (e.g., to the presence or absence of network access). The reconfiguration module 132 is also involved in adaptation of the interaction of the network entities cooperating with the interface apparatus 11 to the terms of an agreement on the quantity and quality of the external cloud services between the providers of these services and their client (i.e., the user or owner of the interface apparatus).

In operation, the reconfiguration device 132 through the wireless network connector 120 checks availability of network communications. According to an embodiment of the present invention, the wireless network connector 120 receives inquiry from the reconfiguration device 132 to find an available network, receives information about the available network connection and forwards this information to the reconfiguration device 132. Depending on the availability of the network communications in the network infrastructure, the reconfiguration device 132 switches the interface apparatus 11 to operate in one of the following three modes:

(I) When access to the global Internet is available, the interface apparatus 11 operates with maximum functionality, and uses all available (under the terms of the agreement with the providers) external cloud services which are provided by the external network entities 101. In this case, the reconfiguration device 132 configures and controls interaction with the external network entities 101 in accordance with the terms of the agreement of the user with the providers.

(II) In the absence of access to the Internet, but nevertheless, in the presence of a local area network (LAN), e.g., a home network, the reconfiguration device 132 of the configuration and control system 129 switches the interface apparatus 11 to an operation mode with a limited external functionality. In this mode, the interface apparatus 11 seeks the required services only among those which are available in the LAN. The searched LAN services can be analogues to the external cloud services (e.g., speech recognition and conducting dialog with the user, support for parental control and monitoring of the child user, etc.), however with less resources. If such services are found in the LAN, these services could be activated to perform the required tasks for the interface apparatus.

(III) In the absence of any kind of network access, the configuration and control system 129 switches the interface apparatus 11 to an autonomous (i.e., offline) mode, in which the interface apparatus 11 relies solely on its internal resources, such as the local dialog organization device 142, the front-end communication system 112, the front-end monitoring system 113, the decision-making system 114, etc.

According to an embodiment of the present invention, the cyber certificate database 130 participates in dynamic reconfiguration of the operations and functionality of the interface apparatus 11, as well as in dynamic reconfiguration of the operations of the network entities 101 for the desired interaction with the interface apparatus 11 to provide required external cloud services to the user 10. According to an embodiment, the cyber certificate database 130 stores one or more data objects or data complexes including multiple interrelated data objects having a tree-like internal structure that can be expressed by means of any structured data description language, such as XML, JSON, etc. The cyber certificate database 130 may include one or more data sections. Each data section can, for example, be represented by a separate object data, including one or more records.

Thus, according to some embodiments of the present invention, the cyber certificate database 130 can include a section with records of the functional characteristics of the interface apparatus 11. This section can include a declarative description of the configuration parameters and the current state of the internal devices of the interface apparatus 11.

The devices of the interface apparatus 11 can be configured to operate in various modes with different functional characteristics. For example, a sensitivity of the front-end monitoring devices MDs of the front-end monitoring system 113 can be controlled. In particular, the sensitivity and measurement accuracy can be high, when the front-end monitoring devices MD is required to react to slight changes in monitored parameters of the user. However, a sensitivity and measurement accuracy of the front-end monitoring devices MDs can also be low, when changes in monitored parameters may be relatively large, and quick reaction on the monitored parameters of the user is required.

According to a further example, the sensor data collection device 124 can be configured for receiving user state patterns measured only by selected front-end monitoring devices MDs of the front-end monitoring system 113. Depending on the measurement requirements, the front-end monitoring devices MD that were not selected for operation, can be temporarily disabled, and therefore do not operate. Furthermore, the section of the cyber certificate database 130 with the configuration parameters of the sensor data collection device 124 can include a polling rate for defining how often a poll should be conducted for checking the front-end monitoring devices that operate in the interface apparatus 11 at any specific time. Depending on the measurement requirements, a polling rate can be changed dynamically, because on the one hand, a high polling rate allows more accurate monitoring of the user, and on the other hand, a large amount of received monitored data of patterns may delay handling the data by the processor within a certain time period.

According to yet an example, the speech synthesizer 107 of the communication processing system 111 can also be configured to have various voice characteristics and speaking styles of the synthesized voice, e.g., a male voice or a female voice, a child voice or an adult voice, a phrase intonation, simulations of speaker emotions, etc.

According to still a further example, the encoding and decoding module 109 can also have a variety of options for coding and decoding of audio and video signals. In particular, a configuration section of the cyber certificate database 130 may include a record with description of the specific codecs used to encode and transmit the audio and video streams.

It should be understood from the above examples, that each particular interface apparatus 11 may have different settings and modes of operation. It should be understood that although examples of configurations are described above only for several devices of the interface apparatus 11, other devices and systems of the interface apparatus 11 can also be configurable, mutatis mutandis. These configurations settings of all the elements of the interface apparatus 11 are stored in the cyber certificate database 130. The sections with records of the configurations for all the devices stored in the cyber certificate database 130 can be dynamic in nature. Accordingly, the records in the cyber certificate database 130 may be changed dynamically during operation of the interface apparatus 11.

According to some embodiments of the present invention, the cyber certificate database 130 can further include a section with records of functional characteristics of the external network entities 101 which are selected to cooperate with the interface apparatus for a predetermined purpose. This section describes the functional properties required for the external network entities so as to ensure a proper operation and functions for the interface apparatus 11. This section is usually pseudo-dynamic, in the sense that the records do not change on the fly, but rather are updated as a result of a dedicated process of configuration of the interface apparatus, e.g., during replacement of the firmware of the interface apparatus 11.

For example, when the interface apparatus is used exclusively for conducting dialogs with the child, and is not intended for monitoring physiological characteristics of the user, the cyber certificate database 130 includes a section with a record, which has an instruction to connect to an external (cloud) network entity that can provide a speech recognition service. When desired, this speech recognition service may, for example, activate a feature for recognition of an emotional state of the child's speech, if this feature is available in this external network entity. Moreover, the record may include instructions to employ an intellectual knowledge search service, if this service is provided by a corresponding external (cloud) network entity. However, since conducting of dialogs with the user does not involve monitoring child's characteristics, this section should include also a record with an instruction for disabling operation of the sensor data collection device 124.

According to one embodiment of the present invention, the section in the cyber certificate database 130 with a record of functional characteristics of the external network entities can include mere abstract declarations (i.e., statements of types and categories) of the required services without identification of their specific addresses (e.g., URLs) for access through the Internet. In this case, the concrete services specified in such a record will be searched by the corresponding external (cloud) network entity (101*a* in FIG. 1) that is dedicated for providing various services required for control, configuration, diagnostics and support of various services cooperating with the interface apparatus 11.

According to an embodiment of the present invention, the system 100 includes such an external network entity (referred to as an entities control system 133) that is designed for providing various services required for control, configuration, diagnostics and support of various services cooperating with the interface apparatus 11. It should be understood that the entities control system 133 can be implemented through any suitable combinations of hardware, software, and/or firmware.

According to an embodiment of the present invention, the entities control system 133 is run by a dedicated provider (not shown) and is configured for providing various cloud services assigned to the interface apparatus 11, in accordance with an agreement between a customer (e.g., the owner or user of the interface apparatus) and this provider. For instance, the customer can have a service contract with the provider.

As will be described hereinbelow in detail, the entities control system 133 cooperates with the reconfiguration module 132 of the configuration and control system 129, and conducts search and configuration of the cloud services of the provider for interaction with interface apparatuses 11, in accordance with the terms of service agreements between the provider of cloud services and the owner of the interface apparatus 11. The entities control system 133 can, inter alia, be configured for conducting a semantic search and management of interaction with the network entities that provide cloud search services to the user 10 of the interface apparatus 11.

According to some embodiments of the present invention, the cyber certificate database 130 can further include a section with a record including a description of the functional characteristics of those network entities that provide services to which the interface apparatus has a right to access. This section may also include records with indications of quality of these services, and functional options available in accordance with the terms of the agreement (contract) between the provider of cloud services and the client (i.e., the owner or user 10 of the smart interface apparatus 11).

For example, if the interface apparatus 11 is intended exclusively for conducting dialog conversations with the user, it can have access only to some specific service features provided by the corresponding network entities stipulated by the contract with the provider of the cloud services. For instance, the entities control system 133 can provide speech recognition service, but concurrently disable the feature of providing emotional color of the speech, because in the agreement between the client and provider this option was not included. Likewise, the entities control system 133 can support the feature of organization and conducting dialogs, but disable the feature of adaptation of the speech to the user's emotions, because this option was not included in the contract with the service provider.

According to an embodiment of the present invention, the record of the cyber certificate database 130 that includes specific service features stipulated by the contract with the provider of cloud services is "static", in the sense that it cannot be changed by means of the interface apparatus itself. In this case, the records may only be changed during the special configuration of the interface apparatus by the cloud service provider. This record in the cyber certificate database 130 can, for example, be protected by a digital signature of the provider of cloud services. Moreover, the record can also be encrypted by means of cryptographic protection of the data.

According to some embodiments of the present invention, the cyber certificate database 130 can further include an archive section including a record with a description of interactions of the user 10 with the interface apparatus 11. The archive section stores history information about all the transactions and events occurred chronologically in the history of the interactions of the user 10 with the interface apparatus 11.

For example, the archive section can include history information about dialogs of communication of the user with one or more external network entities that provide dialogs with the user. Configuration and operation of such entities will be described hereinbelow in detail.

According to another example, the archive section can include history information about dialogs of the communication of the user with the interface apparatus itself. As was described above, this feature can be supported by the local dialog organization device 150 built-in the interface apparatus 11.

According to still another example, the archive section can include history information about all the recognized situations that occurred during the interactions of the user with the interface apparatus, presented, for example, chronologically in a historic perspective.

According to some embodiments of the present invention, the cyber certificate database 130 can further include a section with a cyber portrait of the user. The cyber portrait can, for example, include one or more characteristics selected from cognitive characteristics of the user, behavioral characteristics of the user, physiological characteristics of the user, mental characteristics of the user, etc. These characteristics can, for example, be derived from automatic research, diagnostics and statistics carried out by the decision-making system 114 of the interface apparatus 11 as a result of an analysis of the data collected by the front-end monitoring system 113. Likewise, the cyber portrait of the user can be formed from operation of the corresponding external entities, as will be described hereinbelow in detail.

It should also be noted that the cyber certificate database 130 may further include any other sections required for interaction of the interface apparatus 11 with the network entities 101.

According to an embodiment of the present invention, the cyber certificate database 130 is controlled by the cyber certificate database controller 131 that is configured for controlling access to the records stored in the cyber certificate database 130 for reading and updating records of one or more sections of the cyber certificate database 130. For example, the functions of the cyber certificate database controller 131 include, but are not limited to, retrieving data from records of the relevant sections of the cyber certificate database 130; adding and updating data in records in the relevant sections of the cyber certificate database 130; controlling access of external entities to records in the relevant sections of the cyber certificate database 130; monitoring and ensuring data integrity of the cyber certificate database 130, for example, by creation of backups, use of a special coding, support of the possibility of data recovery in the cyber certificate database 130, etc.

In operation, the cyber certificate database controller 131 receives requests to access the certain sections of the cyber certificate database 130 to retrieve records thereof, and/or requests for modification (update) of the records of corresponding sections of the cyber certificate database 130. These requests can be received from the reconfiguration module 132 as well as from the corresponding external network entities through the wireless network connector 120. After receiving the requests, the cyber certificate database controller 131 updates the corresponding records in the cyber certificate database 130, or retrieves data from the corresponding records and redirects these data to the requester.

According to an embodiment of the present invention, automatic search and configuration of the external cloud systems and devices of the network entities interacting with the interface apparatus 11 for providing various services are carried out by the reconfiguration module 132 in cooperation with the cloud entities control system 133 that is operated by a provider of the cloud services.

In operation, the reconfiguration device 132 receives external signals from the entities control system 143 to adjust the interface apparatus to the operating conditions of the communication network 102. Moreover, the reconfiguration module 132 participates in the adjustment of operation of the external network entities to the predetermined requirements imposed on these network entities for interaction with the interface apparatus 11.

According to some embodiments of the present invention, configuration of the external network entities for interaction with the interface apparatus 11 is carried out in two stages. In the first stage, a selection and configuration of the network entities is carried out in accordance with the requirements of the agreement between the user and the provider of the cloud services. In this case, the dynamic reconfiguration device 132 of the interface apparatus 11 sends an order to the entities control system 133 for fetching a specific network entity required for this interface apparatus. The order includes a list of desired functionality and working parameters consistent with the agreement between the user and the provider. These parameters can be stored in the corresponding record of the cyber certificate database 130. In turn, the entities control system 133 provides a search of the required network entity, configures and parameterizes this network entity as requested in the order, and provides an interaction session of the entity with the interface apparatus 11.

For example, in order to establish communication between the interface device and the external dialog system 140, the dynamic reconfiguration device 132 forms a request declaring that a network entity providing dialog service required for this interface apparatus with a list of specific requirements. Examples of the requirements include, but are not limited to, a condition that the external network entity is owned and maintained by the specified provider (with whom the owner of the toys has a licensing agreement for providing services); a condition that the external network entity provides a service for conducting dialogs with the user of the interface device; the external dialog system should also provide an analysis of emotional speech features, when such features are required for conducting dialogs; the external dialog system should have a search engine to be able to retrieve information from a database for a special knowledge, e.g., in the field of biology, geography, etc.

According to an embodiment of the present invention, the reconfiguration module 132 sends a request to the cyber certificate database controller 131, which retrieves records from two types of sections of the cyber certificate database 130. The records from the section of the first type include a description of the functional characteristics of the network entities 101 required to the specific interface apparatus 11 for a certain purpose, whereas the records of the second type of include a description of the functional characteristics of the network entities 101 that provide those required services to which the interface apparatus has permission to access, in accordance with the agreement between the owner (or user) of the specific interface apparatus 11 and the providers of the required services.

These two types of records are provided to the reconfiguration module 132. In turn, the reconfiguration module 132 forwards these two types of records to the entities control system 133 through the wireless network connector 120. These records are forwarded together with a request for connection to the specified cloud services with the required functional options and with required quality of the service parameters, which are declared in these two records.

Upon receiving a request including a description of the required services from the reconfiguration module 132, the entities control system 133 analyzes the corresponding sections in the cyber certificate database 130 in which the services to which the interface apparatus has permission to access are described, identifies the corresponding network entity providing the requested service, and verifies the conformity of the records in the cyber certificate database 130 with the description of the functional characteristics of the network entities, so as to ensure that these network entities enable providing the required services. This verification can, for example, be carried out by using the digital signature of the corresponding service provider, in order to exclude possible situations of fraud and unauthorized modification of data for this record. This record can be decrypted (if it is stored in the cyber certificate database 130 in an encrypted form). Then, the entities control system 133 conducts a search of those network entities that provide the cloud services defined in the corresponding records of the cyber certificate database 130.

Further, the network entities (that were found by the entities control system 133) are configured to provide the interface apparatus 11 with all the necessary functional options and the quality of the requested services. After configuration of the network entities 101, the entities control system 143 sends a report to the reconfiguration module 132 on results of the configuration along with the specified network addresses of the services, and the access conditions to all the configured cloud entities. From this moment, the interface apparatus 11 can interact with these network entities for common solving of the desired problems, e.g. for conducting dialogs with the child, providing parents monitoring and control, detailed analysis of the situations which occurred with the child, etc.

In the second stage, a further configuration of the interacting network entity is carried out by the reconfiguration device 132 during interaction. In particular, during interaction of the interface apparatus with an external entity, the interface apparatus may require some additional, certain special control actions on these services (within the borders of the general configuration carried out at the first stage), e.g., to disable, temporarily, speech analysis, if necessary, and then to turn it back on. Likewise, to instruct the external dialog system 140 to switch the dialog style to another virtual communication partner, and accordingly to provide another response to the same replica of the user. For this purpose, the reconfiguration device 132 sends control signals to the relevant network entities for further parameterization of their cooperation with the interface apparatus 11, in accordance with the specific technical capabilities of the particular interface apparatus. In operation, the reconfiguration module 132 provides instruction signals to the cyber certificate database controller 131 to read and update the records stored in the cyber certificate database 130 with information about the current situation, for example, with the current information about the network entities which currently cooperate with the interface apparatus and the current parameters of these network entities.

After such two stages configuration, the interface apparatus 11 can interact with the configured external entities to jointly solve the required tasks. Examples of such tasks include, but are not limited to, conducting speech dialogs with the child, parental control and monitoring of the child user, detailed analysis of situations with a child, etc.

In operation, a user or a supervisor of the user of the interface apparatus can carry out a first configuration and/or further reconfiguration of the interface apparatus 11. A reconfiguration of functionality of the interface apparatus results in the changes of the functionality of the interface apparatus as well in the changes of the terms of conditions for providing cloud services.

The supervisor of the user can, for example, be a parent of the child user 10 or any other owner of the interface apparatus 11. The configuration and reconfiguration of the interface apparatus as well as the parameterization of the services for operation of the interface apparatus can, for example, be carried out by using a supervisor communication device 145 through a supervisor support system 144.

The supervisor support system 144 is a network entity providing support for control by a supervisor of the interface apparatus and monitoring of the user 10. Examples of the suitable supervisor communication devices 145 include, but are not limited to, smart phones, tablet computers, personal digital assistance (PDA) devices, laptop computers, smart TV devices, multimedia devices (e.g., set-top-boxes) with access to IP networks or any other devices that can provide communication through the network 102.

For example, as a result of the corresponding instructions of the supervisor, the supervisor control system 144 can form a special declaration data prescribing predetermined characteristics of the interface apparatus, which are needed for its operation and access to the cloud services assigned to the interface apparatus. For example, the parents can carry out a remote setting of the toy's parameters, e.g., to switch off the function for recognition of emotional state of the child from his speech, etc.

The declaration data can, for example, be signed by a digital signature of the provider, and optionally barred from public access by means of cryptographic protection of the data. Thereafter, this configuration data signal that bears the declaration data, is forwarded through the wireless network connector 120 to the reconfiguration module 132 cooperating with the cyber certificate database controller 131 of the configuration and control system 129 of the interface apparatus 11.

Responsive to this configuration data signal, the reconfiguration module 132 provides a corresponding instruction signal to the cyber certificate database controller 131 to make or update a corresponding record in the cyber certificate database controller 131 with a description of functional characteristics of the network entities that provide various services to which the interface apparatus 11 has permission to access.

Following the above description of the interface apparatus 11, examples of several network entities 101 interacting with the user using the interface apparatus 11 will be described hereinbelow in detail.

According to an embodiment of the present invention, the interface apparatus can interact with an external dialog system 140. In relation to the interface apparatus 11, this system is an external network entity (101*b* in FIG. 1) that provides additional functionality to the interface apparatus 11. The external dialog system 140 is configured for organization and conducting natural language dialogs with the user and can be implemented through any suitable combinations of hardware, software, and/or firmware.

In operation of the interface apparatus shown in FIGS. 3 and 4, the external dialog system 140 receives from the wireless network connector 120 the coded information input signals captured by the microphone 117 of the front-end communication system 112 and coded by the encoding and decoding module 109. These coded information input signals are analyzed by the external dialog system 140. In response to these input signals, coded information output signals are generated as a reaction to the coded information input signals. This analysis is performed generally in similar manner to the analysis performed by the local dialog organization device 150, however has more extended facilities, as will be described hereinbelow in detail.

According to an embodiment, the external dialog system 140 includes a speech recognition system 141 configured for receiving coded information input signals which originates from the front-end communication system and transforming these signals into data suitable for computer processing, and a dialog manager 142 coupled to the speech recognition system 141. The dialog manager 142 is configured to process the data received from the speech recognition system 141 and to generate the coded information output signals responsive to the input signals.

According to some embodiments of the present invention, the speech recognition system 141 provides a speech recognition service that allows for the interface apparatus to conduct dialogs with the user in natural languages. In operation, speech recognition system 141 recognizes speech fragments received from the interface apparatus 11 and converts the speech fragments into a format suitable for computer processing. Then, these data of the converted speech fragments are subsequently transmitted to dialog manager 142 for further processing.

For example, the data generated by the speech recognition system 141 can be represented as text strings. Likewise, these data may be presented as data objects having arbitrary tree-like internal structure, expressed, for example, by such known markup languages as XML, JSON, etc.

Speech recognition may be carried out by any suitable algorithm. Examples of the suitable speech recognition algorithms include, but are not limited to, a method of hidden Markov models (HMM), a sliding window method, a method of dynamic time warping, methods based on neural networks, etc. These methods are known per se, and therefore are not expounded herein in detail.

According to an embodiment of the present invention, the interface apparatus can use several alternative speech recognition services, provided by different providers having different functional characteristics. Moreover, the speech recognition services can have different characteristics. In particular, different interface apparatuses may receive services with different functionality and quality, depending on the current settings of service agreement between the service provider running the speech recognition system 141 and the corresponding customers. The customers can, for example, be owners of the interface apparatus, such as the parents of the child users.

The speech recognition system 141 (providing the speech recognition service) can have a variety of adjustable speech parameters and additional functions. For example, the speech recognition system 141 can be tuned to one or more specific speech languages and include the ability of automatic language detection. Moreover, the speech recognition system 141 can include the ability to operate with several languages and to provide for speech recognition of spoken words and phrases in different languages. Further, the speech recognition system 141 can include the ability of automatic age classification of the voice of the user based on the speech characteristics, i.e., to classify the speaker according to his age and to determine whether the speaker is a child, a teen, an adult, or an old person. Furthermore, the speech recognition system 141 can include the ability to determine gender characteristics of the speaker (e.g., a male or a female). Likewise, the speech recognition system 141 can include the ability for automatic detection of emotional states of the speaker, and other speech parameters.

Control of the speech recognition system 141 of the external dialog system 140 can be dynamic in nature during the sessions of its interaction with the corresponding interface apparatuses 11, and can be carried out as a result of cooperative work with the configuration and control system 129 and with the entities control system 133.

As described above, in operation, the reconfiguration device 132 of the configuration and control system 129 sends a request to the entities control system 133 on a required service with the desired operating parameters and functionality for this particular interface apparatus 11. Responsive to this request, the entities control system 133 conducts the required search, finds an external entity 101 which provides the requested service, configures (parameterizes) the service in accordance with the requested characteristics, and provides a service interaction session of this entity with the interface apparatus.

Examples of the existing speech recognition services suitable for the purpose of the present invention include, but are not limited to, a speech recognition service of Google (e.g., the Google Voice Search feature which is run in mobile devices based on the Android operating system), voice services used in the Siri Assistant of Apple, etc.

According to an embodiment, the dialog manager 142 is configured for organization and conducting an interactive dialog between the interface apparatus 11 (e.g. in the form of a smart child's toy) and the user 10 (e.g., a child). In operation, the speech recognition system 141 provides the dialog manager 142 with a dialog replica presented in a format suitable for computerized processing. As described above, this dialog replica may for example, be in the form of a text string (i.e., a line of text) or a structured data object. This dialog replica can be provided together with the results of additional analysis of speech, such as classification of the speaker by age, gender, emotional state of the speaker, etc. Then, the dialog replica is analyzed (for example, by using a semantic analysis based on known patterns of anthologies), and a context model of conversational situations is formed based on the results of the analysis of the dialog replica together with additional data on the characteristics of the speaker. When the context model has been formed in the previous dialog session, an adjustment of the previously formed model can be made. Then, the dialog manager 142 generates a response replica (or a series of response replicas), taking into account the current context model of conversational situations. The response replica can be generated in a format suitable for automatic computer processing, e.g. in the form of a text string or a structured data object. Then, the response replica is transferred to the wireless network connector 120 of the interface apparatus 11, which in turn relays it to the speech synthesizer 108 of communication processing system. In turn, the speech synthesizer 108 transforms the response replica into a voice speech output signal in a natural language. Then, this voice speech output signal is fed to the speaker 115 of the front-end communication system 112 for outputting it to the user 10.

According to an embodiment, the dialog manager 142 can also provide the speech synthesizer 108 with additional attributes of the voice data signals, such as with characterization of the voice options (male, female or child voice), and how to pronounce all the fragments of the response replica (e.g., volume, timbre, intonation and emotional color of each portion of the spoken response replica). These data attributes can have an arbitrary tree structure, and can be expressed by means of known data description languages, such as language VoiceML, etc.

For a more extensive and accurate model of the speech context, and thus for achieving a more accurate dynamic adaptation of the dialogs under complex situations of interaction with the interface apparatus, the dialog manager 142, in addition to the contextual data generated from speech recognition system 141, can also send inquiries to the interface for remote monitoring 119 from which it can obtain information about the recognized current situations along with the flow of data from one or more front-end monitoring devices of the front-end monitoring system 113.

According to an embodiment of the present invention, different interface apparatuses may use the same or several alternative dialog services offered by different providers and having different functional characteristics. Moreover, different interface apparatuses using the same service may receive different types of functionality and quality of the service, depending on the current settings of service agreement between the service provider and its customer (i.e., the owner or user of a particular interface apparatus 11).

According to an embodiment of the present invention, the external dialog system 140 can include a search engine 143 configured for search and retrieval of various information and knowledge on certain topics from other entities. It should be understood that during dialogs with a user, certain situations can occur in which the user can ask sophisticated questions. Accordingly, in order to generate qualitative responses to these sophisticated questions, the dialog manager 142 may be required to acquire certain knowledge on specific subjects. In these cases the external dialog system 140 can use the search engine 143 and obtain knowledge about a particular fact, phenomenon or other subjects.

In operation, the search engine 143 receives a search query from the dialog manager 142 required for satisfaction of the user's information needs. The query can, for example, be formulated as a regular text line. The search engine 143 conducts a search and provides the dialog manager 142 with the requested information.

It should be understood that the dialog manager 142 can use several alternative intellectual knowledge search services offered by different providers, each having different functional characteristics. An example of the search engine 143 includes, but is not limited to, the intellectual knowledge search engine Wolfram Alpha developed by Wolfram Research. This is an online service that answers factual queries directly by generating an answer from the structured data. It should be understood that when more than one search engine is employed, the different search engines may receive a different type of functionality and quality of the search service, depending on the current settings of the service agreement between the service provider and its customer (e.g., the owner or user of a particular interface apparatus 11).

The control and management of the search engine 143 can be dynamic in nature and carried out during the interaction sessions of the dialog manager 142 with the corresponding search services provided by the search engine 143. Control can be carried out as a result of the cooperative work of the dialog manager 142 with the configuration and control system 129 and the entities control system 133. In operation, the reconfiguration device 132 of the configuration and control system 129 sends a request to the entities control system 133 on the required dialog service with the desired operating parameters and functionality for the particular interface apparatus 11. Responsive to this request, the entities control system 133 conducts the required search of the external dialog system 140, configures the dialog service in accordance with the parameters recorder in the cyber certificate database 130 and provides the dialog service interaction session with the interface apparatus 11.

According to an embodiment of the present invention, the interface apparatus can interact with the supervisor communication support system 144. In relation to the interface apparatus 11, this system is an external network entity (101*c* in FIG. 1) that provides additional functionality to the interface apparatus 11.

The supervisor communication support system 144 is configured for supporting connection of the supervisor communication devices 145 to the interface apparatus 11. In particular, the supervisor communication support system 144 is configured to find a supervisor communication device 145 used by a supervisor of the user 10, and to support communication of the user interface apparatus 11 with the supervisor communication device 145.

For example, the user can be a child, and the supervisor can be a parent of the child. In this case, the interface apparatus 11 can be in the form of a smart interactive toy with which the child is regularly in immediate contact. The supervisor communication device 145 can be a smart phone, a tablet computer, a laptop and any other smart communication device available to the parent. In operation, the parent communication device 145 is connected to the supervisor communication support system 144, and sends requests to perform certain functions for access to the interface apparatus (e.g., the smart child's toy) 11.

According to one example, the parent communication device may sent a request to the supervisor communication support system 144 for obtaining access to the video and audio signals of the video camera 116 and the microphone 117 for remote monitoring of the child user 10. According to another example, the parent communication device may send a request to the supervisor communication support system 144 for obtaining organization of the voice channel for remote communication with the child. According to a further example, the parent communication device may send a request to the supervisor communication support system 144 for retrieving data from all the front-end monitoring devices (MD) of the front-end monitoring system 113. According to yet another example, the parent communication device may send a request to the supervisor communication support system 144 for obtaining notifications of the recognized situations occurring with the child user which are of interest to the parents. According to still another example, the parent communication device may send a request to the supervisor communication support system 144 for obtaining a history of dialogs of interactions of the child with the external dialog system 140 and with other cloud services, etc.

Upon receiving a request from the supervisor (parent) communication device 145, the supervisor communication support system 144 approaches the available resources of the interface apparatus via the wireless network connector 120 and obtains an encoded video stream from the camera 116 and an encoded audio stream from the microphone 117. Likewise, through the interface for remote monitoring 119, the supervisor communication support system 144 obtains a stream of notifications of emerging situations occurring with the child, and also obtains access to a stream of raw data from all the front-end monitoring devices of the front-end monitoring system 113. The information data obtained thereby are processed, and then are forwarded to the supervisor communication devices 145.

According to a further embodiment of the present invention, in order to establish a long distance two-way voice/image communication between the child and the parent, the supervisor communication support system 144 can send audio and/or video streams that contain the voice and image of the parent from the parent communication device 145 to the interface apparatus 11. These audio and video streams can be played through the speaker 115 and display 118 built-into the interface apparatus 11. In turn, the voice and image of the child captured by the built-in microphone 117 and video camera 116 can be captured by the supervisor communication support system 144 and forwarded to the parent communication devices 145.

Moreover, as described above, by using the supervisor communication support system 144, the parents or any other supervisors can perform configuration and management of the functionality of the interface apparatus 11 and the interaction of the interface apparatus 11 with the cloud services provided by the network entities 101 serving this interface apparatus 11.

According to an embodiment of the present invention, the interface apparatus 11 can interact with a situation identification system 146 that is coupled to the supervisor communication support system 144. In relation to the interface apparatus 11, this system is one of the external network entities 101 that provides additional functionality to the interface apparatus 11. The situation identification system is configured for receiving the coded information input signals from the front-end communication system and the user state patterns forwarded by the decision-making system, and for providing analysis thereof for identification of various situations occurring with the user, and notification of the supervisor communication support system 144 about the situations as they are discovered.

The functionality and nature of the tasks of the situation identification system 146 largely duplicate and expand the functionality of the decision-making system 114. However, in contrast to decision-making system 114, the situation identification system 146 does not perform any active action. The main task of the situation identification system 146 is analysis of the data flows from the interface apparatus to reveal all sorts of situations occurring with the child and notifying the supervisor communication support system 144 about these situations as they are discovered.

Resources of the situation identification system 146 can be greater than the resources of the pattern recognition and decision-making system 114. This provision allows more fine and granular analysis, including substantive analysis of the situations. For example, a detailed analysis of the situation identification system 146 can be a specialized medical diagnostic service, which can provide remote diagnostics of the health status of the child on the basis of the information signals received from the interface apparatus. Such a diagnostic service may include the detection and tracking of the external behavioral symptoms of some diseases, such as epilepsy, cerebral palsy and others.

According to an embodiment of the present invention, the situation identification system 146 may receive the information signals originating from the microphone 117. In this case, the user information input signals generated by the microphone 117 are processed by the communication processing system 111 and then are fed to the wireless network connector 120 that in turn relays the corresponding coded signals to the situation identification system 146. For example, the situation identification system 146 can be configured to perform analysis of the sound environment around the child, and the child's speech, when desired.

According to a further embodiment of the present invention, the situation identification system 146 may also receive information signals originating from the video camera 116. In this case, user information input signals generated by the video camera 116 can be processed by the communication processing system, and then be fed to the wireless network connector 120 that relays the corresponding coded signals to the situation identification system 146. In turn, the situation identification system 146 can be configured to carry out visual analysis of the situation which occurred with the child, as well as visual analysis of the child's behavior, including recognition of current motor activity (e.g., gestures, posture, gait, character movement, etc.), activity of facial muscles (e.g., facial expressions), eye movement, etc.

According to yet an embodiment, the situation identification system 146 may also receive the raw user state patterns originating from the front-end monitoring devices of the front-end monitoring system 111. As described above, the user state patterns captured by the sensor data collection device 124 are fed to the pattern recognition device 125. If none of the user state patterns matches at least one reference state pattern stored in the pattern storage device 126, the decision making system 114 forwards these monitored user state patterns through the interface for remote monitoring 119 and through the wireless network connector 120 to the situation identification system 146 configured for handling user patterns. These pattern data from the front-end monitoring system 111, together with the incoming audio and video signals, enable the situation identification system 146 to perform detailed analysis of the received data in order to detect, identify and evaluate situations occurring with the child user 11.

According to yet an embodiment, the situation identification system 146 may also receive a description of the characteristics of voice and speech from the speech recognition system 141. These data can also be useful for detection, identification and evaluation of the situations occurring with the child user 11.

After receiving the coded information input signals from the front-end communication system and the user state patterns forwarded by the decision-making system, the situation identification system 146 performs analysis of these signals for identifying various situations occurring with the user and notifies the supervisor communication support system 144 about the situations occurring with the child user 11, as they are discovered. These notifications can further be transferred to the supervisor communication device 145, e.g., for notification of the parent or other supervisor of the child user.

In some cases, notifications of emergency situations can be transferred to other interested parties, such as to a terminal device of the doctor (not shown) in charge of the child, or to the police. When required, in case of critical situations that threaten the life and health of the child, the notifications can be transferred to rescue and other emergency services, etc.

According to an embodiment of the present invention, the front-end monitoring system 113 can receive an alternative service of the situation identification system 146 offered by the different providers having different functional characteristics. Moreover, the different interface apparatuses may receive different types of the functionality and quality of the service provided by the situation identification system 146, depending on the service agreement between the service provider and its customer (e.g., the owner or user of a particular interface apparatus 11).

The control and management of the situation identification system 146 can be dynamic in nature and can be carried out as a result of the cooperative work of the reconfiguration device 132 of the configuration and control system 129 and the entities control system 133.

According to an embodiment of the present invention, the interface apparatus 11 can interact with a peer communication support system 147 that is coupled to one or more peer interface apparatuses 148 associated with peers. For example, the user of the interface apparatus 11 can be the child user 10, the peers can be friends (not shown) of the child user, and the peer interface apparatuses 148 can be other interface apparatuses similar to the interface apparatus 11, which are used by these friends. In relation to the interface apparatus 11, the peer communication support system 147 is one of the external network entities 101 that provides additional functionality to the interface apparatus 11.

The peer communication support system 147 is configured for finding one or more other interface apparatuses 148 used by the corresponding peers to the user, and for supporting communication between the interface apparatus of the user and these other interface apparatuses 148.

The main purpose of the peer communication support system 147 is to provide a channel of communication between the different interface apparatuses that allows the users (e.g., children) associated with these interface apparatuses to place calls to each other, and thereby to communicate with each other over the network. In other words, the peer communication support system 147 operates as a switch that locates the requested interface apparatus upon the request of another interface apparatus, and provides a communication session between these two apparatuses with a channel of a voice traffic transmission in the form of the signal coded by the encoding and decoding module 109.

In operation, when the peer communication support system 147 receives a request to organize connection with another interface apparatus, it searches the requested interface apparatus, and relays this request to the found interface apparatus to start a communication session. In case of confirmation of the request, the peer communication support system 147 establishes a connection between the initiating apparatus and the searched apparatus. In the course of further interaction of the interface apparatuses within the communication session, the voice of the child which is converted into an electronic format by means of the microphone 117 and coded by the encoding and decoding module 109 is fed to the wireless network connector 120. In turn, the wireless network connector 120 relays it to the peer communication support system 147. The peer communication support system 147 transfers this information input signal to the peer interface apparatus, which in turn, after decoding this signal by the encoding and decoding module, is relayed to the speaker of the peer interface apparatus for audio outputting.

It should be noted that a request to establish a communication session between two or more interface apparatuses may have different representations. In particular, it can be a voice query in the form of a speech snippet in a natural language. The voice query may include an instruction (command) to establish a connection together with an identification of the searched apparatus. Such recognition of the voice query and identification of the searched apparatus can be carried out by the peer communication support system 147 in cooperation with the speech recognition system 141 and the dialog manager 142.

According to an embodiment of the present invention, the interface apparatus 11 may also use the service of one or more other peer communication support systems (alternative to the peer communication support system 147) with other functional characteristics. These other peer communication support systems can be run by other providers. It should also be understood that different interface apparatuses may receive different types of functionality and quality of the services from the peer communication support system 147 and from alternative peer communication support systems, depending on the settings of the service agreements between the service providers and its customers (e.g., the owners or users of these interface apparatuses).

The control and management of the peer communication support system 147 can be dynamic in nature and can be carried out as a result of the cooperative work of the reconfiguration device 132 of the configuration and control system 129 and the entities control system 133.

Figure 5:
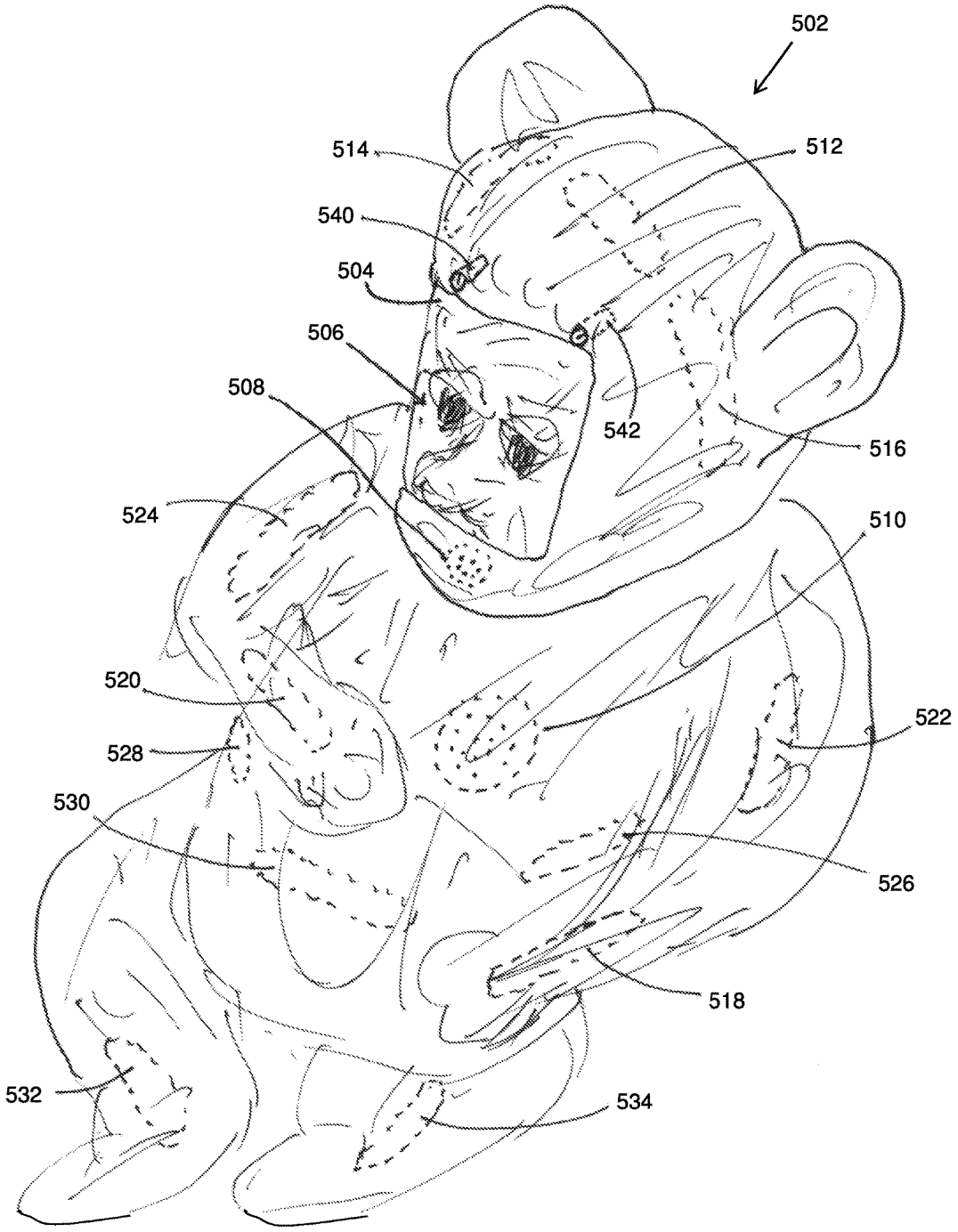
FIG. 5 illustrates an example of an interactive toy plaything, according to various embodiments of the present disclosure.

FIG. 5 illustrates an example of an interactive toy plaything, according to various embodiments of the present disclosure. As shown in FIG. 5, the interactive toy plaything 502 is in the form of a teddy bear. In this example, the teddy bear body 502 includes a torso with a head and four appendages which are limbs of the teddy bear. It should be clear that other forms and any number of appendages are possible in various embodiments of an interactive toy plaything. A display 504 is located in the teddy bear body 502, in this example, in the head of the teddy bear, with the display 504 being oriented outward from an outer surface of the head of the teddy bear 502, as shown.

The display 504 is communicatively coupled with a processor in the teddy bear 502 and operates to display one or more images 506 at the display 504. As shown in FIG. 5, a displayed image 506 includes an image of a face of a person. This image, for example, can represent a face of a user of a remote entity such as a mobile phone device that is communicatively coupled with the processor of the teddy bear 502 via a wireless communication network (not shown in FIG. 5). As an alternative, the image 506 displayed from the display 504 can be a native toy face such as that of a teddy bear toy. As a second alternative, the image 506 can be one or more images corresponding to a person that may be associated with the teddy bear 502, or the mobile phone, or both.

An audio output device 922 (shown in FIG. 9), such as one or more speakers 508, is located, in this example, in the head of the teddy bear body 502 at a location coinciding with that of a traditional teddy bear mouth. The audio output device 922, 508 is oriented outwardly from an outer surface of the teddy bear body 502 as shown. An audio output device 508 can generate audio output signals that are audible by a user of the interactive teddy bear 502. These audio signals outputted from the audio output device 508, in the current example, are audible in an ambient environment surrounding the teddy bear 502. Optionally, certain audio output devices can output signals that are selectively audible by one or more users of the interactive toy plaything 502. For example, and not for limitation, a headset with one or more speakers may be communicatively coupled with audio output circuits in the interactive toy plaything 502. The headset, such as when worn by a user, can provide output sound signals that are selectively audible to the user. These audio output sound signals, from the headset, are not generally audible in an ambient environment surrounding the teddy bear 502, while contemporaneously being audible by the user wearing the headset.

According to the present example, at least one audio input device 923 (see FIG. 9), such as one or more microphones 510, is located in the body of the teddy bear 502 as shown. The audio input device 510 can interoperate with the processor in the teddy bear 502 to capture audio signals from the ambient environment surrounding the teddy bear 502. These audio signals may include sound generated by a user of the teddy bear 502. The processor 904 can analyze the captured audio signals to detect and recognize sounds made by a user of the interactive toy plaything 502. The captured audio signals can be stored in memory. The processor 904, according to certain embodiments, can compare a captured set of audio signals with previously captured and stored set of audio signals corresponding to a respective set of sounds made by the user, to determine whether the currently captured audio signals correspond to new sounds made by the user (e.g., new sounds made by a child interacting with the toy 502). According to various embodiments, the processor 904 can operate with a wireless transceiver 928 (see FIG. 9) to wirelessly communicate over a wireless communication network and thereby wirelessly transmit the captured audio signals corresponding to the new sounds made by the user to at least one remote entity, such as to mom using a mobile phone or to dad using a mobile phone, or to both. Additionally, if the currently captured and stored audio signals fail to match any of the previously captured and stored set of audio signals corresponding to a respective set of sounds made by the user, the processor 904 can add the currently stored audio signals corresponding to sounds made by the user to the set of previously stored audio signals corresponding to a respective set of sounds made by the user. In this way, the processor 904 can keep track of a growing set of sounds made by the user of the teddy bear toy 502. When new sounds made by the user are detected by the processor 904, the processor 904 can operate to wirelessly transmit the new sounds to one or more remote entities, such as to mom using mom's mobile phone and to dad using dad's mobile phone.

One or more haptic detectors can be located in the teddy bear body 502 to detect touching or contact of the outer surface of the teddy bear 502 by a user thereof. For example, touching pressure may be sensed and detected when applied to an outer surface of the teddy bear body 502.

As shown in the example of FIG. 5, a plurality of haptic detectors 512, 514, 516, is located about the head portion of the teddy bear body 502. A plurality of haptic detectors 518, 520, 522, 524, is located in the appendages to the teddy bear body 502 corresponding to arms thereof. A plurality of haptic detectors 532, 534, is located in the appendages of the teddy bear body 502 representing the legs thereof. Lastly, a plurality of haptic detectors 526, 528, 530, is located in the torso portion of the teddy bear body 502. The plurality of haptic detectors 526, 528, 530, in the torso portion of the teddy bear body 502 can be monitored by the processor to detect when a user of the teddy bear 502 is touching the torso, and possibly hugging the teddy bear 502.

One or more visual image input devices 540, 542, such as comprising video cameras, are located about the head portion of the teddy bear body 502, such as above the display 504 as shown. These video image input devices 540, 542, may be strategically located on the teddy bear body 502 to capture stereoscopic video image information from the ambient environment surrounding the teddy bear 502. That is, for example, the images captured by the respective visual image input devices 540, 542, can be combined into stereoscopic video image information by the processor (not shown in FIG. 5) in the teddy bear 502. This stereoscopic video image information can be provided to a remote entity (e.g., over a communication network link) that with a display device can display a three dimensional perspective view of the ambient environment captured by the video image input devices 540, 542. The captured video image information, for example, can represent a perspective view of a user of the teddy bear 502 located in the field of view of the plurality of video image input devices 540, 542, as shown.

A three dimensional perspective view of the user of the teddy bear 502 can be captured and forwarded to a remote entity such as a mobile phone, smart phone, or other wireless communication device, that is communicatively coupled with the processor in the teddy bear 502 via a wireless communication network (not shown in FIG. 5). In this way, a remote entity, such as a mobile phone can receive and monitor video image information of the ambient environment surrounding the teddy bear 502 and particularly of the user of the teddy bear 502.

Additionally, audio signals from the ambient environment surrounding the teddy bear 502 may be captured by the audio input device 510 and relayed to the remote entity, such as the mobile phone, that is communicatively coupled with the processor in the teddy bear 502. A user of the mobile phone, in this way, can monitor the visual image of the ambient environment, possibly including a user of the teddy bear 502, and can monitor the audio in the ambient environment surrounding the teddy bear 502, possibly of the user of the teddy bear 502. The audio capture features of the present disclosure will be discussed in more detail below.

Figure 6:
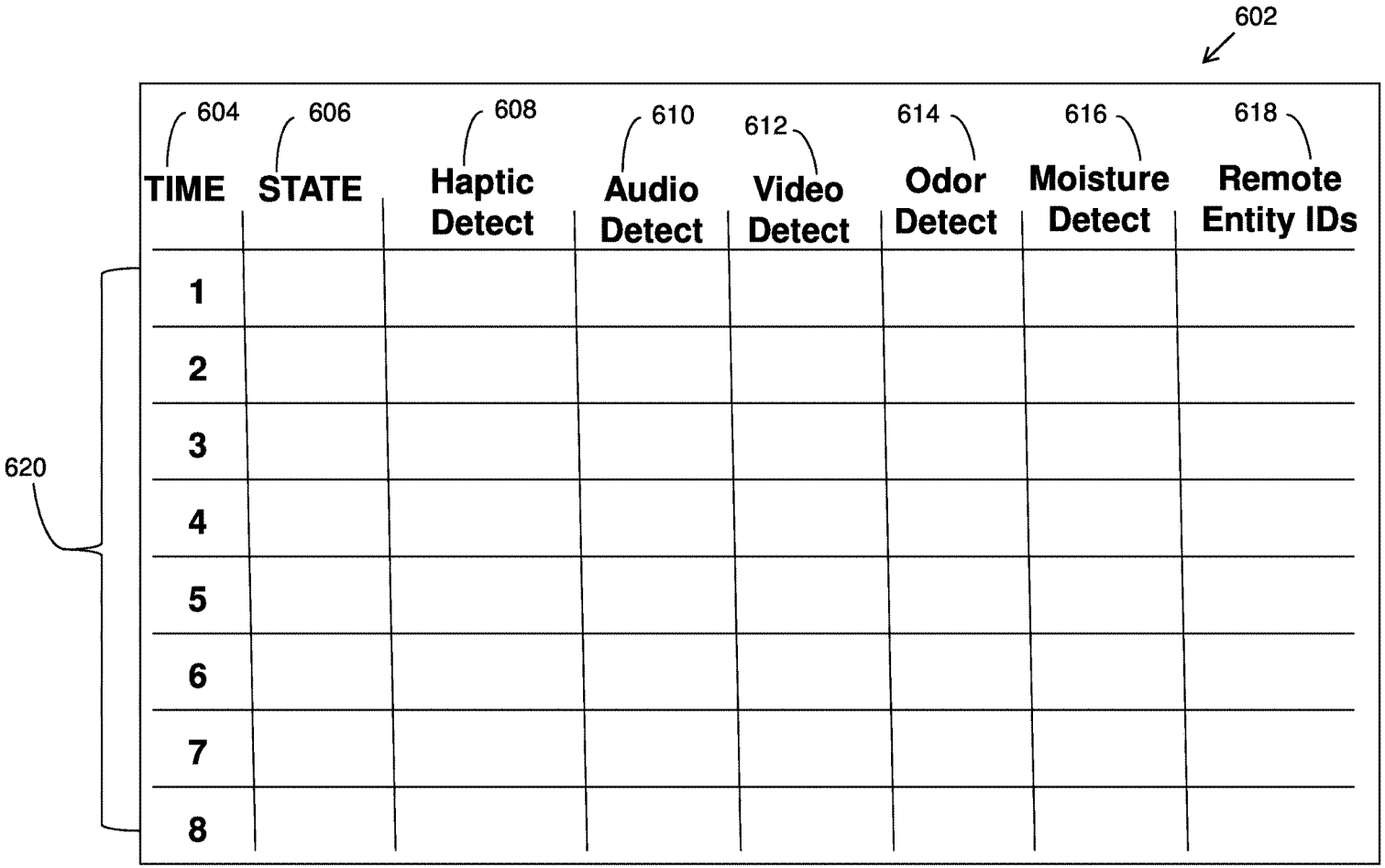
FIG. 6 is a table showing one example of a history repository for the interactive toy plaything of FIG. 5.
Figure 8:
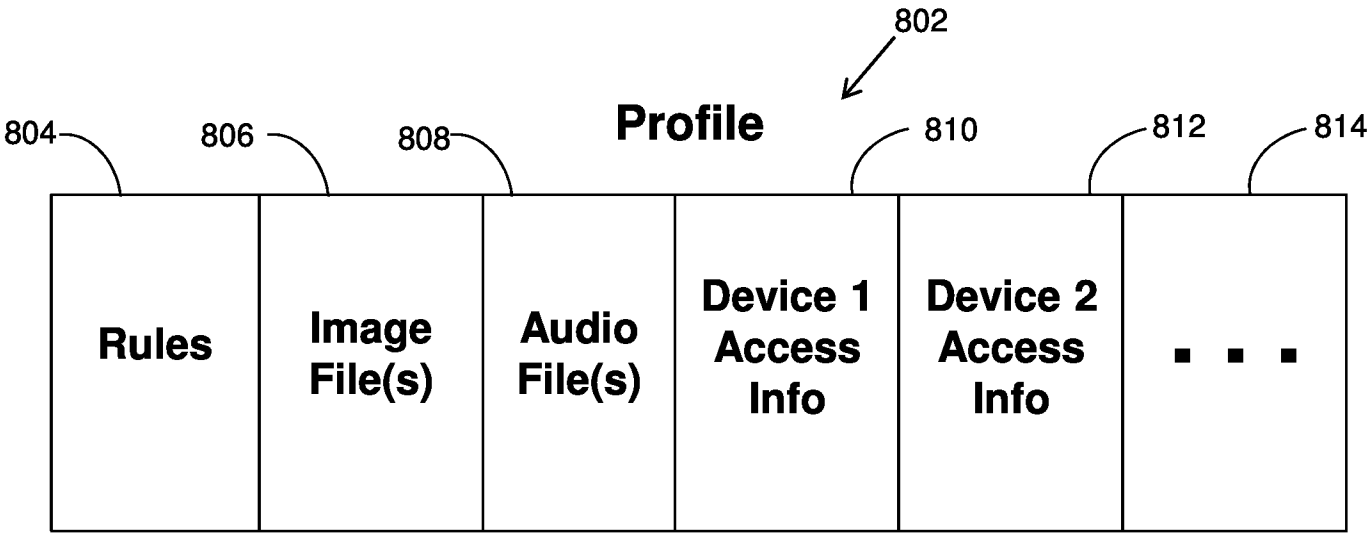
FIG. 8 is a data structure block diagram illustrating one example of an entity profile memory for the interactive toy plaything of FIG. 5.

Referring to FIGS. 6, 7, 8, and 9, an information processing system 902 in the interactive toy plaything 502 is shown, according to one example. FIGS. 6, 7, and 8, illustrate examples of data structures stored in the non-volatile storage 908 of the information processing system 902. These will be discussed in more detail below. The information processing system 902 includes a processor 904 that is communicatively coupled with the memory 906 and with the non-volatile memory (or non-volatile storage) 908.

Figure 9:
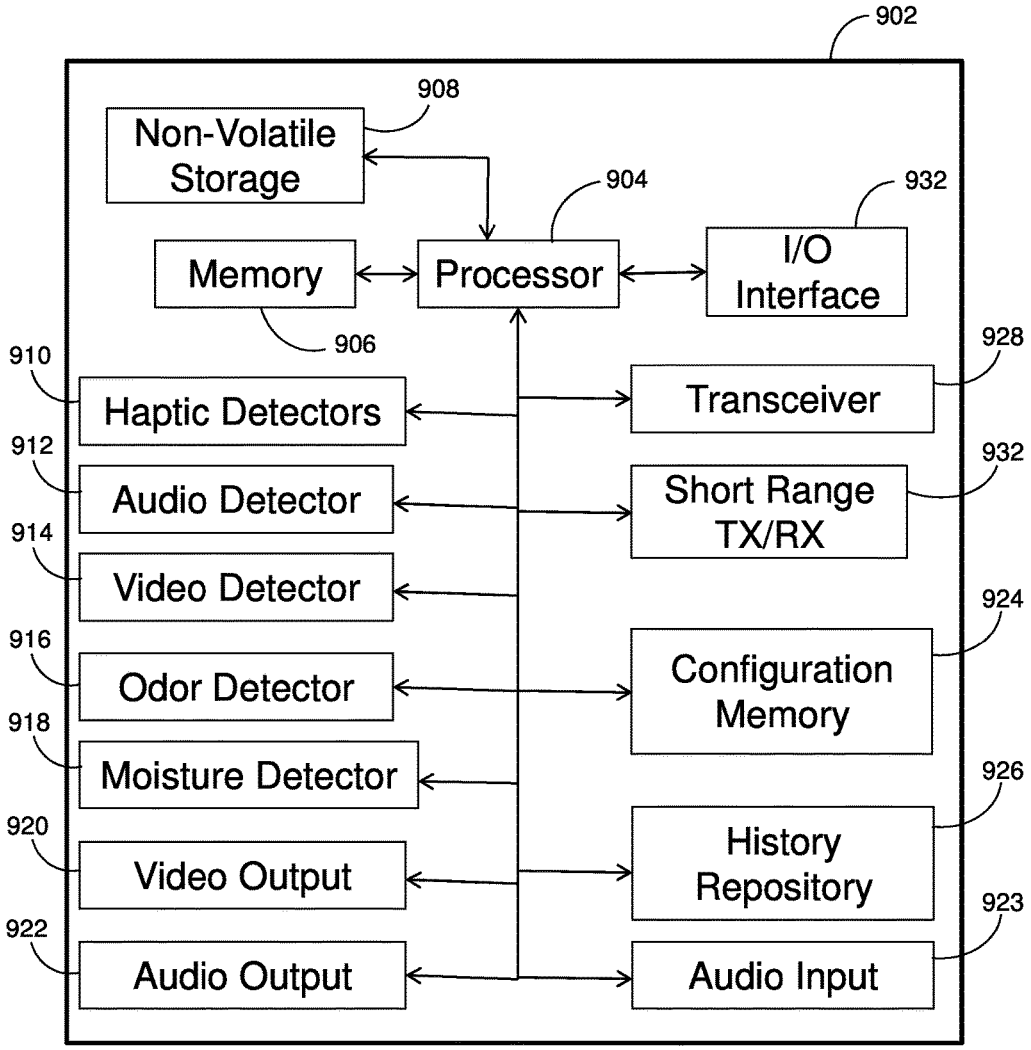
FIG. 9 is a schematic block diagram illustrating an example of an information processing system for the interactive toy plaything of FIG. 5.

Computer instructions, data, and configuration parameters, for use by the information processing system 902 may be stored in any one or more of the memory 906, the non-volatile storage 908, and a computer readable storage medium (not shown in FIG. 9). The computer readable storage medium is communicatively coupled with the information processing system 902 and the processor 904 via the input/output (I/O) interface 932 that is communicatively coupled with the processor 904. The I/O interface 932 may comprise, for example and not for limitation, any one or more of a wired interface, a wireless interface, and an optical interface. The processor 904, responsive to executing the computer instructions, causes the processor to perform operations according to the instructions.

Various detectors and output devices are communicatively coupled with the processor 904, according to the present example. For example, a plurality of haptic detectors 910, at least one audio detector 912, at least one video detector 914, at least one odor detector 916, at least one moisture detector 918, at least one video output device 920, and at least one audio output device 922, are all communicatively coupled with the processor 904 in the information processing system 902.

A transceiver 928 is communicatively coupled with the processor 904 and interoperates with the processor to wirelessly transmit and wirelessly receive information via a wireless communication network link (not shown). A short range transmit and receive circuit 930 is communicatively coupled with the processor 904 and allows short range wireless communication between the interactive toy plaything 502 and other systems and devices in proximity thereto. For example, another interactive toy plaything may include similar circuits such as a short range transmit and receive circuit and processor whereby the two interactive toy playthings may communicate information between their respective processors.

A history repository 926 is communicatively coupled with the processor 904 in the information processing system 902 as shown. The history repository stores information associated with the information processing system 902 over several time periods, such as illustrated in the example shown in FIG. 6. This example in FIG. 6 will be discussed in more detail below.

A configuration memory 924, communicatively coupled with the processor 904, stores configuration parameters and other information that can be used by the processor 904. For example, an entity identification table 702 shown in FIG. 7 can be stored in the configuration memory 924. This entity identification table 702 is used by the processor 904, according to various examples of the present disclosure, to identify one or more remote entities that can communicate with the information processing system 902.

Each row in the table 702, according to the present example, includes information associated with one entity. For example, an entity may correspond with a mobile phone that is remotely located with respect to the interactive toy plaything 502. Alternatively, an entity may correspond to a remotely located lap top PC or a desktop PC that is remotely located to the interactive toy plaything 502. Each remote entity can be communicatively coupled with the information processing system 902 via a wireless communication network, a wired network, or a combination thereof. The transceiver 928 can be used by the processor 904 to establish a communication link with the wireless communication network and thereby inter-communicate information between one or more remote entities and the information processing system 902.

As shown in FIG. 7, each row in the table 702 includes information associated with one entity. The entity may be remotely located or locally located with respect to the location of the information processing system 902 of the inter-active toy plaything 502. In both cases, the entity is configured to intercommunicate with the inter-active toy plaything 502.

First of all, each entity is identified by an entity ID code 704. This entity ID code 704 uniquely identifies each entity in the information processing system 902. A profile 706 is maintained for each entity as shown. The profile information 706 in the table 702 is linked to a separate profile data structure 802 for each entity. An example of a profile 802 for a remote entity that is listed in the entity identification table 702 is shown in FIG. 8.

Continuing with reference to FIG. 7, status information 708 is maintained for each entity. The status information can include status of availability to communicate with the information processing system 902. That is, the entity at certain times may not be available to communicate with the interactive toy plaything 502, while at other time the entity is available. The status information 708 may also include other types of status information with respect to the remote entity.

Each entity is also identified with a respective source of audio 710 and a source of video 712. These source identifications 710, 712, may include addresses for the particular sources of either audio or video information that can be received from that particular entity such as over the wireless communication network. For example, these sources may be identified by IP addresses. In similar fashion, destinations for audio information 714 and video information 716 can be identified for each entity in the table 702. These destination identifications can include a destination IP address for the audio information and for the video information. The destination identification 714, 716, can be used by the processor 904 to transmit information to the entity. For example, with the respective destination IP address and other information for the entity, audio information, video information, or both, can be transmitted from the information processing system 902 via the wireless communication network to a remote entity such as a mobile phone, a smart phone, a tablet, a laptop PC, or the like.

As mentioned above, each entity is defined to include a profile 706 for the particular entity. This profile in the table 702 links to a profile data structure 808 as shown in FIG. 8. This profile information 802 for a particular entity, according to the present example, includes a set of rules 804 for the information processing system 902 to determine how and when to inter-operate and communicate with the particular entity.

The profile information 802 also includes one or more image files 806 that may be stored locally in the information processing system 902, or stored in a computer readable storage medium coupled with an external non-volatile storage system (not shown) that is readily accessible by the information processing system 902, or that may be stored in a combination of both locally stored and externally stored information according to various embodiments. Similarly, the profile information 802 also can include one or more audio files 808 that can be stored locally in the information processing system 902, or stored in a computer readable storage medium coupled with an external non-volatile storage system (not shown) that is readily accessible by the information processing system 902, or that may be stored in a combination of both locally stored and externally stored information according to various embodiments.

The profile 802 includes access information for one or more devices that are associated with the particular entity. In FIG. 8, the example shows first device access information 810 and second device access information 812 stored in the profile 802 for a particular entity. For example, the first device can be a mobile phone, and the second device can be a tablet computer, both associated with the same user of the particular entity. Device access information 810, 812, can include the necessary addressing information, communication protocol configuration information, and other access information, that can be used by the information processing system 902 to establish communication and communicate with the particular entity via one or more device(s) associated with the entity in the profile 802. Other profile information 814 may also be included in the profile 802 for a particular entity.

As mentioned above, a history repository 926 is communicatively coupled with the processor 904 and maintains history information regarding the operation of the information processing system 902 in the inter-active toy plaything 502. As illustrated in the example in FIG. 6, a history repository 602 may include history information for several time intervals 620 during a window of time in which operation of the information processing system 902 is tracked. The history repository 602 is shown as a table where each row contains captured information for a particular time interval.

Each time interval row 620 can include various history information 602 associated with the particular time interval. Each row represents a time interval in the tracked history of the information processing system 902 and the interactive toy plaything 502. In the present example, there are eight time intervals (eight rows) maintained for history information. The information stored in time interval row 1, as an example, represents the latest capture of information, while the information stored in time interval row 8 represents the oldest tracked history information. The set of eight time intervals provides a moving window of time in which operation of the information processing system 902 is tracked. The time duration for each time interval can be set according to particular implementations. The time duration for each time interval 620 may be defined to be any desired time duration.

According to various embodiments, a plurality of history tables 602 is stored in the history repository 926. That is, for example, one history table 602 may correspond to short term history and another history table 602 may correspond to long term history.

The short term operation of the information processing system 902 over a set of short term time intervals can be tracked in the short term history table 602. For example, each of the 8 time intervals 620 may correspond to a 10 seconds interval of operation of the information processing system 902. That is, the eight time intervals 620 would cover an eighty second moving window of time for the operation of the information processing system 902.

In accordance with various embodiments, a second history table 602 is used to track long term history of operation of the information processing system 902. For example, each of the time intervals 620 in the second history table 602 may correspond to a three-hour interval of operation of the information processing system 902. That is, the eight time intervals 620 would cover an entire twenty four hour moving window of time (one day) for the operation of the information processing system 902.

In summary, a short term history window of time may be maintained for operation of the information processing system 902 as well as a long term history window of time therefor. The short term history can be used by the processor 904 to track recent operations (short term patterns of operations) associated with the information processing system 902. The long term history may be tracked by the processor 904 to monitor long term patterns of operations of the information processing system 902. In this way, the processor 904 can adjust its operations, determine what actions to take for the interactive toy plaything, and be responsive to short term patterns of operations of the information processing system and long term patterns of operations of the information processing system 902. The information processing system 902, for example, can use a set of rules stored in the configuration memory 924 that guide the information processing system 902 to make decisions as to what next action to take for the interactive toy plaything 502 based on the history information 602, e.g., in certain embodiments based on at least one of the short term history and the long term history, stored in the history repository 926.

Each of the time intervals 620 is identified by a time slot number 604. State information 606 for the information processing system 902 and the interactive toy plaything 502 is tracked for each of the time slots 620. State information 606 may include information regarding an overall state of the information processing system 902, such as the system 902 being idle or being in certain operational state(s). Optionally, the state information 606 may include more detailed state information regarding specific set of operations of the information processing system 902, or components thereof, during a particular time slot. For example, during a transmission of information from the interactive toy plaything 502 via a wireless communication network to establish communication and communicate with a remote entity such as a smart phone, detailed state information 606 of the progress of a communication protocol and transmission of a set of data packets can be maintained for each time interval 620.

For each of the time intervals 620 the status 608 of each of the set of haptic detectors 910 may be monitored and tracked. The status 610 of the at least one audio detector 912 may also be monitored and tracked for each time interval.

The status 614 of a set of odor detectors 916 and the status 616 of a set of moisture detectors 918 may be tracked as well.

In certain embodiments, visual information captured by the set of or more visual image input devices 540, 542, from the ambient environment surrounding the interactive toy plaything can be analyzed by the processor 904, for example, to detect a moving object in the field of view of the visual image input devices 540, 542. Alternatively, or in addition to the detection of movement, the processor 904 using pattern recognition software can compare the captured visual information to a set of stored visual image information files corresponding to at least one user of the interactive toy plaything 502 (or to a portion of the user's body such as the face or more specifically the user's eyes). The processor 904 in this way can determine the presence of the particular user in proximity to the interactive toy plaything 502, and likely interacting with the toy. This determination of movement and presence of the user by analyzing captured visual information of the ambient environment surrounding the interactive toy plaything 502 is referred to in FIG. 9 as one or more video detectors 914. Accordingly, the status 612 of each of the one or more video detectors 914 can be tracked.

Additionally, the entity IDs 618 for those entities that are associated with the information processing system 902 during a particular time interval may be also tracked. Each remote entity ID 618 stored in the history for a particular time slot 620 identifies uniquely a particular entity that is in the entity identification table 702 shown in FIG. 7. Additionally, the profile 706 shown in the table 702 is linked to a profile data structure 802 shown in FIG. 8 for a particular entity. In this way, significant amount of information may be stored and tracked for the information processing system 902 over a short term history window of time and over a long term history window of time, as stored and updated in the history repository 926.

Figure 10:
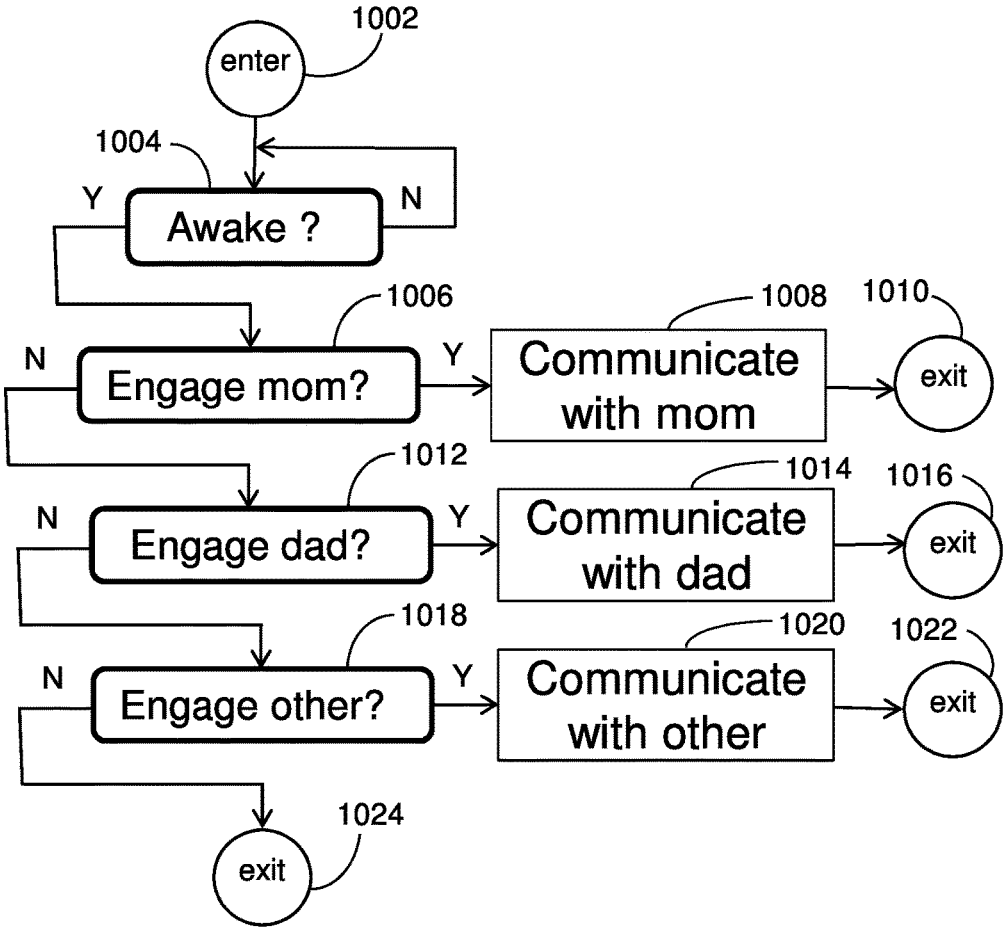
FIGS. 10 and 11 are operational flow diagrams illustrating examples of operational sequences according to various embodiments of the present disclosure.
Figure 11:
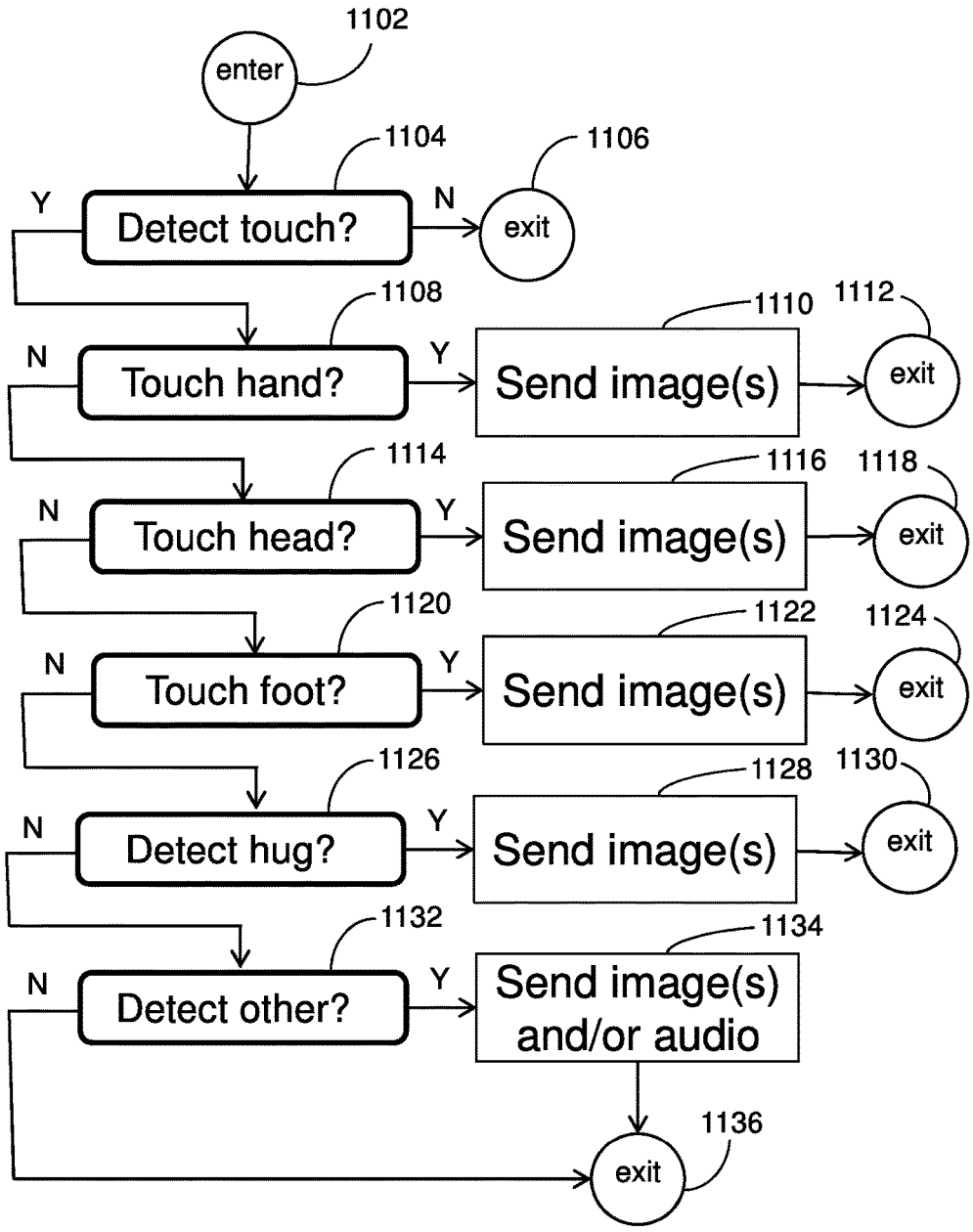

Referring to FIGS. 10 and 11, an example of an operational sequence for the information processing system 902 is shown. The operational sequence is entered, at step 1002, and then the processor 904, at step 1004, determines whether it is time for the interactive toy plaything 502 to enter the awake state or to remain in an idle state. To enter the awake state, according to one example implementation and not for limitation, corresponds to a determination by the processor 904 that the interactive toy plaything 502 is to take certain affirmative physical interaction with a user in the ambient environment surrounding the toy 502.

While the processor 904 continues to determine that it is not time to be in the awake state, at step 1004, the interactive toy plaything 502 remains in the idle state. However, even while in the idle state one or more of the various detectors 910, 912, 914, 916, and 918, continue to operate and monitor the ambient environment surrounding the interactive toy plaything 502. The processor 904 continues to monitor the ambient environment during the idle state such as to detect a physical signal indicating interaction with a user of the interactive toy plaything 502. The processor 904 operates certain monitoring functions (and other idle state operations) while in the idle state according to a set of rules stored in the configuration memory 924. If the processor 904 detects a physical signal indicating interaction with a user of the interactive toy plaything 502, the processor 904 determines it is time for changing the operational state to the awake state.

Additionally, other internal operations of the information processing system 902 may continue during the idle state while the interactive toy plaything 502 appears physically outwardly inactive (i.e., not affirmatively interacting with a user) relative to its surrounding ambient environment and to a user of the interactive toy plaything 502. For example, the information processing system 902 may continue to establish communications and communicate with other devices and systems that are configured to intercommunicate with the information processing system 902. While in the idle state, according to various embodiments, the information processing system 902 may cause an image to be displayed in the display device 504. The displayed image may include a native face of the interactive toy plaything 502, such as the native face of a teddy bear in the current example. The displayed image may include a face associated with a user of one of the remote entities associated with the interactive toy plaything 502. During the idle state the display device 504 could display any image or optionally no image at all.

Upon the processor 904 determining, at step 1004, that it is time to enter the awake state, the processor 904 then determines, at step 1006, whether it is time to engage a remote entity that is associated with a particular user, such as mom using mom's mobile phone or another device. If the conditions determined by the processor 904 at the time of awaking, at step 1004, indicate that it is time to engage mom's mobile phone, at step 1006, then the information processing system 902 establishes a communication link with the wireless communication network via the transceiver 928 and attempts to communicate with mom using mom's mobile phone, at step 1008. Once communication of information between the information processing system 902 and the remote entity that is the person mom using mom's mobile phone device is established, interactions between the child using the toy teddy bear and mom using the mobile phone device can occur.

It should be noted that in various embodiments of the present disclosure, the processor 904 determines to engage a particular entity, such as mom using mom's mobile phone or another device, based on detecting physical interactions between a user and the interactive toy plaything 502. For example, a child may start playing or interacting with the toy teddy bear 502 and this interaction is detected by the processor 904. The detection may be via one or more detectors 910, 912, 914, 916, 918, 923, being monitored with the processor 904.

The child, in certain embodiments, could select what particular entity to interact with via the toy teddy bear 502. That is, if the child wants to interact with mom via the toy teddy bear 502, the child would cause certain interaction that is detected by the processor 904, for example holding the teddy bear's right arm. The processor 904, with a set of the haptic detectors 520, 524, 910, would detect the child touching the right arm of the teddy bear toy 502. In response thereto, the processor 904 determines selection of the remote entity that is mom and attempts to establish communication with mom using mom's mobile phone, based on rules stored in the configuration memory 924.

The processor 904 can check what rules to apply in response to the detection of the right arm being touched. Rules in the configuration memory 924 are checked, such as including rules 804 in the profile 802 associated with each remote entity. The rules 804 in the profile 802 associated with the remote entity that is mom would indicate that the detected physical interaction with the teddy bear toy is a child's selection of interaction with mom.

Alternatively, for example, if the child wants to interact with dad via the toy teddy bear 502, the child would cause certain interaction that is detected by the processor 904. For example, the child would touch the top of the teddy bear's head to select interaction with dad. With the haptic detector 512 in the location of the touching of the teddy bear toy's head, the processor 904 detects the condition and then checks what rule(s) apply in response to the detection of the top of the head of the toy teddy bear 502 being touched. Rules in the configuration memory 924 are checked and the processor 904 attempts to establish communication with dad using dad's mobile phone, based on rules stored in the configuration memory 924.

Continuing with reference to FIG. 10, according to various embodiments, if communication can be established with mom using mom's mobile phone, at step 1008, then the exchange of information and communication with the remote entity that is mom using mom's mobile phone may continue, at step 1008, and the operational sequence exits at step 1010. That is, the remote entity device that is mom using mom's mobile phone is determined available and further the person who is mom is also determined available and currently using mom's mobile phone.

However, the determination of availability of a remote entity, in various embodiments, may be made based only on the remote entity device being determined available. That is, the determination of availability of only mom's mobile phone device results in a determination of availability of the remote entity, without attempting to also determine whether the person who is mom is available and currently using the mobile phone device. In certain of these embodiments, to establish communication and communicate with the remote entity would not require attempting to establish communication with the person using the device, such as mom using mom's mobile phone device. For example, physical interaction between the child using the toy teddy bear can cause interaction-related information to be transmitted to mom's mobile phone device where it could be stored such as for future retrieval by mom when using the mobile phone device. This delayed interaction between, in the present example, the child using the toy teddy bear 502 and mom using mom's mobile phone device facilitates many types of interactions between the child and mom that would otherwise not be possible. That is, mom does not have to be currently using the mobile phone device to be able to interact with the child. Mom could then respond by using mom's mobile phone to send interaction-related information to the child via the teddy bear toy 502, based on the delayed interaction-related information previously received by mom from the child using the toy teddy bear 502. For example, in response to receiving interaction-related information at the mobile phone, mom could speak into the mobile phone and thereby a stream of audio including mom's uttered speech audio can be transmitted from the mobile phone to (destined for reception by) the teddy bear toy 502. The child thereby hears mom talking (a stream of speech audio emitted) from the teddy bear toy 502. Also, mom's image while talking into the mobile phone can be captured by one or more cameras in the mobile phone (e.g., a smart phone) and transmitted as a stream of video information to the teddy bear toy 502 and then displayed as a stream of images on the display 504 for the child to see along with hearing mom's voice talking to the child. This interaction between the child and mom, even if the exchange of information between child and mom may be delayed by some time until mom becomes available to communicate with the child, is a valuable opportunity for the child and mom to interact which may otherwise not be possible.

Continuing with the present example with reference to FIG. 10, if communication cannot be established with mom using mom's mobile phone, at step 1008, such as because the remote entity is unavailable at the present time, then a flag is set in the remote entity status 708 as being unavailable.

The information processing system 902 may then operate based on the remote entity being unavailable, according to the rules 804 that are in the profile 802 for the remote entity that is mom's mobile phone. For example, with the remote entity being determined unavailable, at step 1008, the processor 904 may display at the display device 504 one or more images from the image files 806. As an example, an image 506 of mom's face may be displayed on the display 504 upon a determination that the remote entity associated with the user who is mom is determined unavailable. Optionally, one or more audio files 808 associated with the remote entity that is mom's mobile phone may be played and sound emitted into the ambient environment through the audio output device 922, 508. The audio signals outputted from the audio output device 922, 508 may be heard by a user of the interactive toy plaything 502 while in proximity thereto.

According to various embodiments, the profile 802 associated with a remote entity may include access information 810, 812, for accessing two devices that are each associated with the particular remote entity. For example, access information 810 for device one, may be configured to access the device as a mobile phone associated with a user thereof. Access information 812 for device two may be configured to access the device as, for example, any of a tablet PC, a laptop PC, or a desktop PC, associated with the same user as device one.

According to one example scenario, the processor 904 first attempts to establish communication and to communicate with mom's mobile phone, and if unavailable the processor 904 then attempts to establish communication and to communicate with mom's laptop PC. The rules 804 associated with the particular entity guide the processor 904 in this procedure, as will be discussed in more detail below.

More specifically in the current example, the processor 904 first uses access information 810 to communicate with mom's mobile phone, and optionally also to communicate with mom via the mobile phone. If it is determined that mom's mobile phone is not available, and optionally also that mom is not available to communicate via the mobile phone, then, based on the rules 804, the processor 904 uses access information 812 and attempts to contact and communicate with mom's laptop PC, and optionally also to communicate with mom via the laptop PC.

In this way, for example, the particular user (e.g., mom) associated in a profile 802 with two devices, 810, 812, can be contacted by first attempting contact with the mobile phone and then contact with the laptop PC. Other alternative procedures for attempting to contact an entity associated with two or more devices are also possible. For example, a sequential order based on relative priority of each device can be followed for contacting each of a set of devices. The relative priority of each device can be stored in the profile 802 for the remote entity, such as stored in the rules 804. Attempts to establish communication and communicate with each device in a set of devices would follow a sequential order based on the relative priority for each device in the set.

According to the example shown in FIG. 10, if mom is not to be engaged for interaction with a user of the teddy bear toy, at step 1006, or if mom's remote entity is unavailable, at step 1008, then the processor 904 determines, at step 1012, whether to engage a second remote entity, such as a mobile phone associated with a user that is dad. If the processor 904, at step 1012, determines to engage dad via dad's mobile phone, then the information processing system 902 attempts to establish a communication link with the wireless communication network (not shown) via the transceiver 928. The processor 904 thereby attempts to establish communication and to communicate with the remote entity that is dad's mobile phone, at step 1014.

If communication with dad's mobile phone, and optionally also with dad via dad's mobile phone, is established, at step 1014, then information is exchanged between the information processing system 902 and the remote entity that is the mobile phone associated with dad, at step 1014, and then the operation sequence exits, at step 1016.

If the remote entity that is the mobile phone associated with dad is determined unavailable, at step 1014, then a status 708 for the remote entity is set in the entity identification table 702. The status 708 may indicate that the second remote entity that is dad's mobile phone is unavailable. Additionally, the rules 804 in the profile 802 associated with the second remote entity instruct the processor 904 to display the one or more images 806, and output the one or more audio signals 808 in the ambient environment surrounding the inter-active toy play thing 502.

If the remote entity that is dad's mobile phone, at step 1012, is not engaged, or if dad's mobile phone is determined unavailable, at step 1014, the processor 904 then determines, at step 1018, whether to engage another remote entity, such as a mobile phone associated with grandfather or a mobile phone associated with grandmother. In similar fashion to that discussed above, a communication can be established, at step 1020, with that third remote entity and then the operational sequence exits, at step 1022. Alternatively, if there are no more remote entities to be engaged, at step 1018, then the processor 904 exits the operational sequence, at step 1024.

It should be noted that with a determination that all remote entities are unavailable, at step 1018, the processor 904 may display at the display device 504 one or more images from one or more image files 806 associated with at least one of the remote entities that is associated with the interactive toy plaything 502. As an example, an image 506 of mom's face, or dad's face, or a face of another user of a remote entity, may be displayed on the display 504 upon a determination that all of the remote entities are unavailable. As a first alternative example, a native toy face (e.g., a teddy bear toy face) may be displayed. A second alternative example may be to display a null-image (no image) on the display. As another example, a sequence of alternating display of mom's face, dad's face, and a face of another user of a remote entity, another user, may be displayed on the display 504 upon a determination that all of the remote entities are unavailable.

Optionally, one or more audio files 808 associated with the remote entity that is mom's mobile phone may be played and sound emitted into the ambient environment by the audio output device 922, 508. The audio signals outputted from the audio output device 922, 508 may be heard by a user of the interactive toy plaything 502 while in proximity thereto. As a first alternative example, a native toy sound (e.g., a sound of a toy teddy bear) may be played and outputted from the audio output device 922, 508. As a second alternative example, a null-audio signal (no sound) may be outputted from the audio output device 922, 508.

Referring to FIG. 11, an operational sequence is illustrated for the processor 904, as one example, for determining whether the inter-active toy plaything 502 is being interacted with and whether a remote entity is to be engaged. The processor 904 enters the operational sequence, at step 1102, and then determines, at step 1104, whether a touch has been detected by the haptic detectors 910. If no touch has been detected, at step 1104, then the processor 904 exits the operational sequence, at step 1106.

Alternatively, if the processor 904 detects, at step 1104, a touch via the haptic detectors 910, then, at step 1108, the processor 904 determines whether one or more haptic detectors 518, 520, 910 associated with a hand extending from the arm and torso of the inter-active toy plaything body 502 has been touched. If the processor 904, determines, at step 1108, that the hand has been touched, then the processor 904 determines what remote entity to engage (such as shown in FIG. 10), and information may be exchanged between the information processing system 902 and the particular remote entity by communication established over the wireless communication network. In the present example, one or more visual images captured by the visual image input device 540, 542, may be sent over the wireless communication network to the remote entity, at step 1110. The operational sequence is then exited, at step 1112.

As another alternative, if a touch of the head of the inter-active toy play thing 502 is detected, such as by the one or more haptic detectors 512, 514, 516, at step 1114, then the processor 904 determines what remote entity to engage (see FIG. 10), and then after establishing communication with the particular remote entity information is exchanged including sending one or more images to the remote entity, at step 1116. The operational sequence is then exited, at step 1118.

In similar fashion, if the processor 904 determines that a foot has been touched, at step 1120, then the processor 904 may determine which particular remote entity to engage and establish communications therewith over the wireless communication network. The processor 904 then, at step 1122, operates to send one or more images to the particular remote entity. The operational sequence is then exited, at step 1124.

A hug may be detected, at step 1126, by the processor 904 detecting signals from the torso haptic detectors 526, 528, 530, indicating that a user of the inter-active toy plaything 502 is applying pressure to the outer surface of the torso of the body. In this case, at step 1126, the processor 904 determines which remote entity to engage (see FIG. 10), and then exchanges information with the remote entity, such as by sending one or more images, at step 1128. The operational sequence then exits at step 1130.

Although not shown in FIG. 11, other conditions may be detected by the processor 904, following the test to detect a hug, at step 1132, and before exiting the operational sequence, at step 1136. For example, a moisture detector 918 may be used with the processor 904 to detect when a child is biting on an outer surface of the inter-active toy play thing 502. If such condition is detected, the processor 904 may determine which particular remote entity to engage (see FIG. 10) and establish communications therewith over the wireless communication network, e.g., to exchange interaction-related information therewith. For example, as a response to detecting that the child is biting the teddy bear toy 502, the processor 904 operates to send images and/or audio signals to the remote entity (e.g., mom's mobile phone) that show the child biting the teddy bear toy. The processor 904 then exits the operational sequence, at step 1136.

As another example, an odor detector 916 may interoperate with the processor 904 to detect a particular odor in the ambient environment surrounding the inter-active toy plaything 502. For example, sulfur, urea, or other such chemical that is associated with the child having soiled themselves, may be detected by the odor detector 916 to indicate such conditions as a child's diaper is soiled and may need to be changed. If that condition is detected, at step 1132, then the processor 904 may determine which remote entity to engage (see FIG. 10), such as dad using dad's mobile phone. The processor 904 then attempts to establish communication with the particular remote entity (e.g., dad using dad's mobile phone) and then operates to send interaction-related information such text messages informing dad that the child's diaper needs to be changed, and optionally the processor 904 also sends images and/or audio of the child interacting with the toy teddy bear 502, at step 1134. If no other interaction is detected, at step 1132, then the processor 904 exits the operational sequence at step 1136.

As discussed by various examples above, the child's physical interactions with the teddy bear toy 502 can be monitored by the information processing system 902 and based on the detected interactions and other information monitored (and/or information maintained) by the system 902, the processor 904 can operate to establish communication and communicate with one or more entities over a wireless communication network. Interaction-related information representing the child's interactions with the interactive toy plaything 502 can be wirelessly transmitted over the wireless communication network destined for reception by a remote entity associated with the interactive toy plaything 502. For example, the interaction-related information can be sent to mom's mobile phone thereby informing mom of the child's interactions or alternatively (or in addition to) can be sent to dad's mobile phone thereby informing dad of the child's interactions. The exchange of interaction-related information between the child interacting with the teddy bear toy and one or more remote entities (e.g., mom using a mobile phone and/or dad using a mobile phone) can be received by the each remote entity near real time (e.g., while mom is using mom's mobile phone) or can be received by a delayed time (e.g., until the remote entity is available to communicate with the remote teddy bear toy).

As will be appreciated by one of ordinary skill in the art, aspects of the various examples may be embodied as a system, method, or computer program product. Accordingly, examples herein may take the form of an entirely hardware embodiment, an entirely software embodiment (including firmware, resident software, micro-code, etc.) or an embodiment combining software and hardware aspects that may all generally be referred to herein as a "circuit," "module", or "system." Furthermore, aspects herein may take the form of a computer program product embodied in one or more computer readable media having computer readable program code embodied thereon.

Any combination of one or more computer readable media may be utilized. A computer readable medium may be a computer readable signal medium or alternatively a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electrical, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, object oriented languages such as Java, Smalltalk, C++ or the like, and conventional procedural programming languages, such as the "C" programming language or similar programming languages. The program code may execute entirely on the user's computer, partly on the user's computer, as a stand-alone software package, partly on the user's computer, and partly on a remote computer or entirely on the remote computer. The remote computer, according to various embodiments, may comprise one or more servers. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present disclosure are described with reference to flowchart illustrations and/or block diagrams of methods, apparatus (systems) and computer program products according to various embodiments of the disclosure. It will be understood that one or more blocks of the flowchart illustrations and/or block diagrams, and combinations of blocks in the flowchart illustrations and/or block diagrams, can be implemented by computer program instructions. These computer program instructions may be provided to one or more processors, to a special purpose computer, or to other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner. Instructions stored in a computer readable storage medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

In accordance with various embodiments, the methods described herein are intended for operation as software programs running on a computer processor. Furthermore, software implementations can include, but are not limited to, distributed processing or component/object distributed processing, parallel processing, or virtual machine processing and can also be constructed to implement the methods described herein.

While the computer readable storage medium is discussed above in an example embodiment to be a single medium, the term "computer readable storage medium" should be taken to include a single medium or multiple media (e.g., a centralized or distributed database, and/or associated caches and servers) that store the one or more sets of instructions. The term "computer-readable storage medium" shall also be taken to include any non-transitory medium that is capable of storing or encoding a set of instructions for execution by the machine and that cause the machine to perform any one or more of the methods of the subject disclosure.

The term "computer-readable storage medium" shall accordingly be taken to include, but not be limited to: solid-state memories such as a memory card or other package that houses one or more read-only (non-volatile) memories, random access memories, or other re-writable (volatile) memories, a magneto-optical or optical medium such as a disk or tape, or other tangible media which can be used to store information. Accordingly, the disclosure is considered to include any one or more of a computer-readable storage medium, as listed herein and including art-recognized equivalents and successor media, in which the software implementations herein are stored.

Although the present specification may describe components and functions implemented in the embodiments with reference to particular standards and protocols, the disclosure is not limited to such standards and protocols. Each of the standards represents examples of the state of the art. Such standards are from time-to-time superseded by faster or more efficient equivalents having essentially the same functions.

The illustrations of examples described herein are intended to provide a general understanding of the structure of various embodiments, and they are not intended to serve as a complete description of all the elements and features of apparatus and systems that might make use of the structures described herein. Many other embodiments will be apparent to those of skill in the art upon reviewing the above description. Other embodiments may be utilized and derived therefrom, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense.

Although specific embodiments have been illustrated and described herein, it should be appreciated that any arrangement calculated to achieve the same purpose may be substituted for the specific embodiments shown. The examples herein are intended to cover any and all adaptations or variations of various embodiments. Combinations of the above embodiments, and other embodiments not specifically described herein, are contemplated herein.

The Abstract is provided with the understanding that it is not intended be used to interpret or limit the scope or meaning of the claims. In addition, in the foregoing Detailed Description, various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

Although only one processor 904 is illustrated for information processing system 902, information processing systems with multiple CPUs or processors can be used equally effectively. Various embodiments of the present disclosure can further incorporate interfaces that each includes separate, fully programmed microprocessors that are used to off-load processing from the processor 904. An operating system (not shown) included in main memory for the information processing system 902 is a suitable multitasking and/or multiprocessing operating system, such as, but not limited to, any of the Linux, UNIX, Windows, and Windows Server based operating systems. Various embodiments of the present disclosure are able to use any other suitable operating system. Some embodiments of the present disclosure utilize architectures, such as an object oriented framework mechanism, that allows instructions of the components of operating system (not shown) to be executed on any processor located within the information processing system. The input/output interface module(s) 932 can be used to provide an interface to at least one network. Various embodiments of the present disclosure are able to be adapted to work with any data communications connections including present day analog and/or digital techniques or via a future networking mechanism.

Although the illustrative embodiments of the present disclosure are described in the context of a fully functional computer system, those of ordinary skill in the art will appreciate that various embodiments are capable of being distributed as a computer program product via CD or DVD, e.g. CD, CD ROM, or other form of recordable media, or via any type of electronic transmission mechanism.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. The term "another", as used herein, is defined as at least a second or more. The terms "including" and "having," as used herein, are defined as comprising (i.e., open language). The term "coupled," as used herein, is defined as "connected," although not necessarily directly, and not necessarily mechanically. "Communicatively coupled" refers to coupling of components such that these components are able to communicate with one another through, for example, wired, wireless or other communications media. The term "communicatively coupled" or "communicatively coupling" includes, but is not limited to, communicating electronic control signals by which one element may direct or control another. The term "configured to" describes hardware, software or a combination of hardware and software that is adapted to, set up, arranged, built, composed, constructed, designed or that has any combination of these characteristics to carry out a given function. The term "adapted to"

describes hardware, software or a combination of hardware and software that is capable of, able to accommodate, to make, or that is suitable to carry out a given function.

The terms "controller", "computer", "processor", "server", "client", "computer system", "computing system", "personal computing system", "processing system", or "information processing system", describe examples of a suitably configured processing system adapted to implement one or more embodiments herein. Any suitably configured processing system is similarly able to be used by embodiments herein, for example and not for limitation, a personal computer, a laptop computer, a tablet computer, a smart phone, a personal digital assistant, a workstation, or the like. A processing system may include one or more processing systems or processors. A processing system can be realized in a centralized fashion in one processing system or in a distributed fashion where different elements are spread across several interconnected processing systems.

Those skilled in the art to which the present invention pertains, can appreciate that while the present invention has been described in terms of embodiments, the concept upon which this disclosure is based may readily be utilized as a basis for the designing of other structures, systems and processes for carrying out the several purposes of the present invention.

Also, it is to be understood that the phraseology and terminology employed herein are for the purpose of description and should not be regarded as limiting.

Finally, it should be noted that the word "comprising" as used throughout the appended claims is to be interpreted to mean "including but not limited to".

It is important, therefore, that the scope of the invention is not construed as being limited by the illustrative embodiments set forth herein. Other variations are possible within the scope of the present invention as defined in the appended claims. Other combinations and sub-combinations of features, functions, elements and/or properties may be claimed through amendment of the present claims or presentation of new claims in this or a related application. Such amended or new claims, whether they are directed to different combinations or directed to the same combinations, whether different, broader, narrower or equal in scope to the original claims, are also regarded as included within the subject matter of the present description.

What is claimed is:

1. An interactive toy plaything comprising:

a toy plaything body containing an electronic circuit including:

memory for storing computer instructions and data;

a display oriented outwardly from an outer surface of the toy plaything body;

at least one visual image input device oriented outwardly from an outer surface of the toy plaything body for capturing visual image information from an ambient environment of the interactive toy plaything;

at least one audio output device for outputting audio signals;

at least one audio input device for capturing audio signals from an ambient environment of the interactive toy plaything; and at least one haptic detector located in the toy plaything body to detect touch force pressure applied to an outer surface of the toy plaything body;

a wireless transceiver; and a processor communicatively coupled with the memory, the display, the at least one visual image input device, the at least one audio output device, the at least one audio input device, the at least one haptic detector, and the wireless transceiver, wherein the processor, responsive to executing the computer instructions, performs operations comprising:

monitoring input signals from the at least one audio input device, the at least one visual image input device, and the at least one haptic detector;

determining, based on the monitored input signals, that the interactive toy plaything is being interacted with and that interaction-related information corresponding to the interaction with the interactive toy plaything is to be communicated with at least one remote entity;

determining availability of the at least one remote entity to communicate with the interactive toy plaything over a wireless communication network;

based on determining that the at least one remote entity is available to communicate, wirelessly communicating with the wireless communication network and wireles sly transmitting the interaction-related information to the at least one remote entity and wirelessly receiving information from the at least one remote entity, via the wireless transceiver communicatively coupled with the wireless communication network; and selectively displaying on the display, based on a determined availability of the at least one remote entity, a set of images selected from the following:

a locally stored predefined set of images comprising at least one of a native toy face corresponding to the interactive toy plaything, and a set of images corresponding to a user associated with the at least one remote entity, based on the at least one remote entity being determined currently unavailable;

a stream of images in the information wirelessly received from one of the at least one remote entity via the wireless transceiver communicatively coupled with the wireless communication network, the stream of images comprising an image of a user associated with the one remote entity, based on the at least one remote entity being determined currently available;

selectively outputting a set of audio signals via the at least one audio output device, based on a determined availability of the remote entity, the set of audio signals selected from the following:

a locally stored set of audio signals comprising at least one of a null-audio signal;

a native toy sound interaction corresponding to the interactive toy plaything, and a set of audio signals corresponding to a user associated with the remote entity, based on the remote entity being determined currently unavailable; and a stream of audio signals wirelessly received in the information from the remote entity via the wireless transceiver communicatively coupled with the wireless communication network, the stream of audio signals comprising a set of audio signals generated by a user associated with the remote entity, based on the remote entity being determined currently available, wherein the stream of audio signals wirelessly received in the information from the remote entity comprises speech audio signals uttered by the user associated with the remote entity contemporaneously with transmission of the stream of audio signals from the remote entity to be wirelessly received by the interactive toy plaything.

2. The interactive toy plaything of claim 1, wherein the processor, responsive to executing the computer instructions, performs operations comprising:

capturing visual image information from the at least one visual image input device; and based on determining that the remote entity is available to communicate, wirelessly communicating with the wireless communication network and wirelessly transmitting the captured visual image information in the interaction-related information to the remote entity, via the wireless transceiver communicatively coupled with the wireless communication network.

3. The interactive toy plaything of claim 1, wherein the processor, responsive to executing the computer instructions, performs operations comprising:

capturing, with the at least one audio input device, audio signals from the ambient environment; and based on determining that the remote entity is available to communicate, wirelessly communicating with the wireless communication network and wirelessly transmitting the captured audio signals in the interaction-related information to the remote entity, via the wireless transceiver communicatively coupled with the wireless communication network.

4. The interactive toy plaything of claim 3, wherein the captured audio signals comprise audio signals generated by a user contemporaneously interacting with the interactive toy plaything.

5. The interactive toy plaything of claim 1, wherein the determining availability of the at least one remote entity comprises:

wireles sly transmitting, with the wireless transceiver communicating with the wireless communication network, an interaction request message destined for reception by the at least one remote entity;

monitoring for wireless reception by the transceiver of a request for communication from the at least one remote entity;

determining availability of the at least one remote entity to communicate with the interactive toy plaything over the wireless communication network, based on at least one of the following:

a wirelessly received request for communication from the at least one remote entity indicating that the at least one remote entity is available to communicate; and an expiration of a defined amount of time following the wireless transmission of the interaction request message indicating that the at least one remote entity is unavailable to communicate.

6. The interactive toy plaything of claim 5, the processor, responsive to executing the computer instructions, performs operations comprising:

based on determining that the at least one remote entity is available to communicate with the interactive toy plaything, establishing a wireless video chat session between a user of the interactive toy plaything and a user of the at least one remote entity over the wireless communication network, in which a stream of images wireles sly received from the at least one remote entity via the wireless transceiver is displayed in the display;

a stream of audio signals wirelessly received from the at least one remote entity via the transceiver is outputted with the at least one audio output device;

audio signals from the ambient environment of the interactive toy plaything are captured with the at least one audio input device and wirelessly transmitted via the transceiver over the wireless communication network to the at least one remote entity; and visual image information are captured with the at least one visual image input device from the ambient environment of the interactive toy plaything and wirelessly transmitted via the transceiver over the wireless communication network to the at least one remote entity.

7. The interactive toy plaything of claim 1, wherein the toy plaything body comprises a torso, a head mechanically coupled to the torso, and at least one appendage mechanically coupled to the torso, and wherein the display is located in the head at a location corresponding to a face of the interactive toy plaything, and with the display being oriented outwardly from an outer surface of the head.

8. The interactive toy plaything of claim 7, wherein the toy plaything body comprises a toy teddy bear body and the display is located in a toy teddy bear head at a location corresponding to a face of a toy teddy bear.

9. The interactive toy plaything of claim 7, wherein the at least one haptic detector comprises a plurality of haptic detectors located in the toy plaything body with a first haptic detector located in the head, a second haptic detector located in the at least one appendage, and a third haptic detector located in the torso, and wherein the processor, responsive to executing the computer instructions, performs operations comprising:

monitoring input signals from the first, second, and third haptic detectors;

determining, based on the monitored input signals from the haptic detectors, that the interactive toy plaything is being interacted with and that interaction-related information corresponding to the interaction with the interactive toy plaything is to be selectively communicated with at least one remote entity selected from a plurality of remote entities;

determining availability of a selected at least one remote entity to communicate with the interactive toy plaything over a wireless communication network;

based on the determining that the selected at least one remote entity is available to communicate, wirelessly communicating with the wireless communication network and transmitting the interaction-related information to the selected at least one remote entity via the wireless transceiver communicatively coupled with the wireless communication network; and selectively displaying on the display, based on determining that one of the selected at least one remote entity is available to communicate, a stream of images wireles sly received from the one of the selected at least one remote entity via the wireless transceiver communicatively coupled with the wireless communication network, the stream of images comprising an image of a user associated with the one of the selected at least one remote entity.

10. The interactive toy plaything of claim 1, wherein the toy plaything body comprises a torso, a head mechanically coupled to the torso, and at least one appendage mechanically coupled to the torso; and wherein the at least one haptic detector comprises a plurality of haptic detectors located in the toy plaything body with a first haptic detector located in the head, a second haptic detector located in the at least one appendage, and a third haptic detector located in the torso, and wherein the processor, responsive to executing the computer instructions, performs operations comprising:

monitoring input signals from the first, second, and third haptic detectors;

determining, based on the monitored input signals from the haptic detectors, that the interactive toy plaything is being interacted with and that interaction-related information corresponding to the interaction with the interactive toy plaything is to be selectively communicated with one remote entity selected from at least a first remote entity and a second remote entity, a first combination of input signals from at least one of the first, second, and third haptic detectors indicating selection of the first remote entity and a second combination of input signals, different than the first combination of input signals, from at least one of the first, second, and third haptic detectors, indicating selection of the second remote entity;

determining availability of the selected one remote entity to communicate with the interactive toy plaything over a wireless communication network;

based on the determining that a selected one remote entity is available to communicate, wirelessly communicating with the wireless communication network and transmitting the interaction-related information to the selected one remote entity via the wireless transceiver communicatively coupled with the wireless communication network; and selectively displaying on the display, based on determining that the selected one remote entity is available to communicate, a stream of images wirelessly received from the selected one remote entity via the wireless transceiver communicatively coupled with the wireless communication network, the stream of images comprising an image of a user associated with the selected one remote entity.

11. The interactive toy plaything of claim 1, wherein the toy plaything body comprises a torso, a head mechanically coupled to the torso, and at least one appendage mechanically coupled to the torso; and wherein the at least one haptic detector comprises a plurality of haptic detectors located in the toy plaything body with a first haptic detector located in the head, a second haptic detector located in the at least one appendage, and a third haptic detector located in the torso, and wherein the processor, responsive to executing the computer instructions, performs operations comprising:

monitoring input signals from the first, second, and third haptic detectors;

determining, based on the monitored input signals from the haptic detectors, that the interactive toy plaything is being interacted with and that interaction-related information corresponding to the interaction with the interactive toy plaything is to be selectively communicated with one remote entity selected from at least a first remote entity and a second remote entity, a first combination of input signals from at least one of the first, second, and third haptic detectors indicating selection of a first remote entity and a second combination of input signals, different than the first combination of input signals, from at least one of the first, second, and third haptic detectors, indicating selection of the second remote entity;

determining that a selected one remote entity is the first remote entity and that the first remote entity is unavailable to communicate with the interactive toy plaything over the wireless communication network;

based on the determining that the first remote entity is unavailable to communicate, determining whether a second remote entity is available to communicate with the interactive toy plaything over the wireless communication network; and based on the determining that the first remote entity is unavailable and the second remote entity is available to communicate, wirelessly communicating with the wireless communication network and transmitting the interaction-related information to the second remote entity via the wireless transceiver communicatively coupled with the wireless communication network, and displaying on the display a stream of images wireles sly received from the second remote entity via the wireless transceiver communicatively coupled with the wireless communication network, the stream of images comprising an image of a user associated with the second remote entity.

12. The interactive toy plaything of claim 1, wherein the at least one remote entity comprises a mobile phone, and wherein based on determining that the mobile phone is available to communicate, wireles sly transmitting the interaction-related information to the mobile phone and wireles sly receiving the stream of images from the mobile phone, via the wireless transceiver communicatively coupled with the wireless communication network.

13. The interactive toy plaything of claim 12, wherein the determining, based on the monitored input signals from the at least one haptic detector, that the interactive toy plaything is being interacted with comprises determining that the interactive toy plaything is being hugged; and wherein the wireles sly transmitting the interaction-related information to the mobile phone comprises transmitting virtual reality image information of the interactive toy plaything being hugged.

14. The interactive toy plaything of claim 1, wherein the processor, responsive to executing the computer instructions, performs operations comprising:

automatically reconfiguring and controlling of functionality of the interactive toy plaything, including:

selecting desired functional characteristics of the interactive toy plaything; and dynamically adjusting the interactive toy plaything to operating conditions of the communication network, including a presence or absence of network connections; and automatically reconfiguring and controlling of functionality of interaction of said at least one network entity with the interactive toy plaything, including adjusting said interaction to predetermined requirements imposed on said at least one network entity for desired cooperation with interactive toy plaything in accordance with said predetermined agreement.

* * * * *